US011155109B2

(12) United States Patent
Shimada et al.

(10) Patent No.: US 11,155,109 B2
(45) Date of Patent: Oct. 26, 2021

(54) PROCESSING DEVICE, CONTROL METHOD OF PROCESSING DEVICE, AND RECORDING SYSTEM

(71) Applicant: SEIKO EPSON CORPORATION, Tokyo (JP)

(72) Inventors: Chiaki Shimada, Shiojiri (JP); Tsuyoshi Furumido, Shiojiri (JP); Kenji Uchibori, Matsumoto (JP); Hirohisa Kodaira, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/035,060

(22) Filed: Sep. 28, 2020

(65) Prior Publication Data

US 2021/0094329 A1 Apr. 1, 2021

(30) Foreign Application Priority Data

Sep. 30, 2019 (JP) ..... JP2019-179214
Sep. 30, 2019 (JP) ..... JP2019-179227

(51) Int. Cl.
*B65H 31/32* (2006.01)
*B65H 31/36* (2006.01)
(Continued)

(52) U.S. Cl.
CPC ..... *B41J 13/0045* (2013.01); *B41J 11/0045* (2013.01); *B65H 31/32* (2013.01); *B65H 31/36* (2013.01)

(58) Field of Classification Search
CPC ..... B41J 13/0045; B41J 11/0045; B41J 11/0005; B41J 13/0036; B41J 3/60;
(Continued)

(56) References Cited

U.S. PATENT DOCUMENTS 7,243,913 B2 * 7/2007 Terao ..... B65H 29/34 270/58.08
9,388,014 B2 * 7/2016 Kato ..... B41J 13/106
(Continued)

FOREIGN PATENT DOCUMENTS

JP 2003-246525 A 9/2003
JP 2006-124171 A 5/2006
(Continued)

OTHER PUBLICATIONS

Machine translation of JP 2013-052937, published on Mar. 2013 (Year: 2013).*

*Primary Examiner* — Huan H Tran
(74) *Attorney, Agent, or Firm* — Workman Nydegger

(57) ABSTRACT

A processing device includes a medium supporting portion having a support surface for supporting at least a front end portion of a transported medium, an aligning portion for aligning the medium supported by the medium supporting portion, a stacking portion provided below the medium supporting portion in a vertical direction, having a stacking surface on which the medium dropped from the medium supporting portion is stacked, and configured to move up and down, and a pressing portion having a pressing surface facing the support surface, the pressing surface being configured to move between a first position and a second position closer to the support surface than the first position, in which the pressing portion is disposed at the first position when the medium is transported to the medium supporting portion, and is disposed at the second position after the aligning portion aligns the medium on the medium supporting portion.

10 Claims, 24 Drawing Sheets

(51) Int. Cl.
*B41J 13/00* (2006.01)
*B41J 11/00* (2006.01)

(58) Field of Classification Search
CPC ..... B65H 31/26; B65H 31/32; B65H 31/36; B65H 2301/4212; B65H 2301/4213; B65H 2405/11151; B65H 2801/27; B65H 31/02; B65H 31/3018; B65H 31/10; B65H 31/00; B65H 2405/113; B65H 2701/176
See application file for complete search history.

(56) References Cited

U.S. PATENT DOCUMENTS

| | | | | |
|---|---|---|---|---|
| 2006/0066040 | A1 | 3/2006 | Terao et al. | |
| 2016/0089909 | A1 | 3/2016 | Kato | |
| 2020/0207567 | A1* | 7/2020 | Uchibori ..... | B65H 31/3081 |

FOREIGN PATENT DOCUMENTS

| | | | |
|---|---|---|---|
| JP | 2013-052937 | A | 3/2013 |
| JP | 2016-069163 | A | 5/2016 |
| JP | 2016-069164 | A | 5/2016 |

* cited by examiner

μF > μF'

PROCESSING DEVICE, CONTROL METHOD OF PROCESSING DEVICE, AND RECORDING SYSTEM

The present application is based on, and claims priority from JP Application Serial Number 2019-179214, filed Sep. 30, 2019 and JP Application Serial Number 2019-179227, filed Sep. 30, 2019, the disclosures of which are hereby incorporated by reference here in their entirety.

BACKGROUND

1. Technical Field

The present disclosure is related to a processing device including a medium supporting portion that supports at least a front end portion of a transported medium and a stacking portion that stacks the medium dropped from the medium supporting portion, a control method of the processing device, and a recording system including the processing device.

2. Related Art

JP-A-2013-52937 discloses a processing device having a structure in which a jogger stacking section having a pair of left and right joggers that supports and arranges the transported media and stacks is provided and a bundle of the arranged media is dropped and stacked on a stacking tray by opening the pair of left and right joggers.

For example, a medium subjected to printing by an ink jet printer or the like may curl during the transport, and the curling may hinder the transport of the medium. Further, the curl may hinder the stacking of the medium on the stacking portion. Since the curl often grows, it becomes more and more difficult to transport and stack the medium.

However, in JP-A-2013-52937, there is no description, and no suggestion is made regarding the problem when the transported medium is curled.

SUMMARY

According to an aspect of the disclosure, there is provided a processing device for solving the above-mentioned problems including: a medium supporting portion having a support surface for supporting at least a front end portion of a transported medium; an aligning portion for aligning the medium supported by the medium supporting portion; a stacking portion provided vertically below the medium supporting portion, having a stacking surface on which the medium dropped from the medium supporting portion is stacked, and configured to move up and down; and a pressing portion having a pressing surface facing the support surface, the pressing surface being configured to move between a first position and a second position closer to the support surface than the first position, in which the pressing portion is disposed at the first position when the medium is transported to the medium supporting portion, and is disposed at the second position after the aligning portion aligns the medium on the medium supporting portion.

DESCRIPTION OF EXEMPLARY EMBODIMENTS

Figure 1:
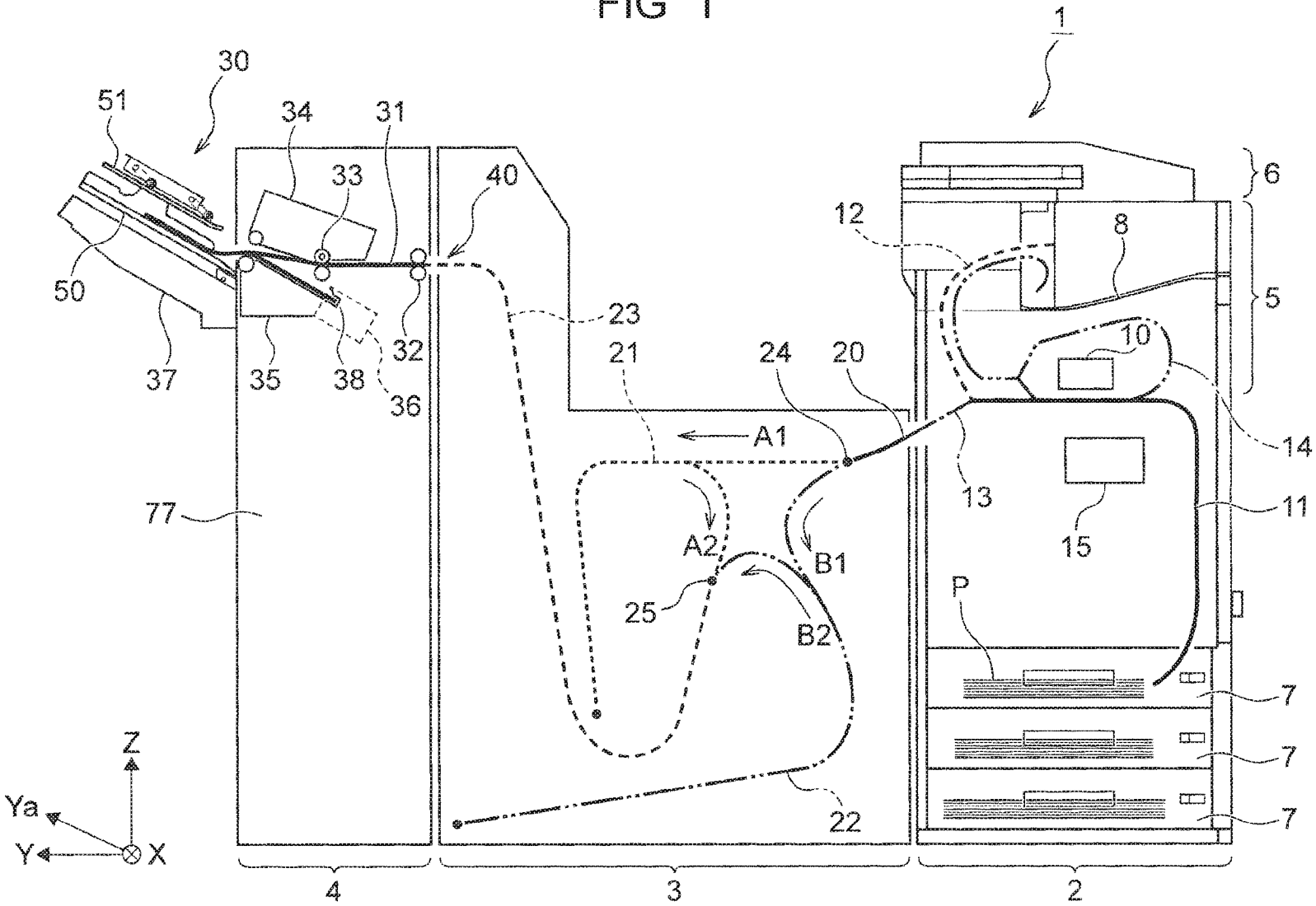
FIG. 1 is a schematic view showing a recording system of the present embodiment.

Below, the technical idea and its effects obtained from the embodiments and modification examples described later will be described.

According to a first aspect of the present disclosure for solving the above-mentioned problems, there is provided a processing device including a medium supporting portion having a support surface for supporting at least a front end portion of a transported medium; an aligning portion for aligning the medium supported by the medium supporting portion; a stacking portion provided vertically below the medium supporting portion, having a stacking surface on which the medium dropped from the medium supporting portion is stacked, and configured to move up and down; and a pressing portion having a pressing surface facing the support surface, the pressing surface being configured to move between a first position and a second position closer to the support surface than the first position, in which the pressing portion is disposed at the first position when the medium is transported to the medium supporting portion, and is disposed at the second position after the aligning portion aligns the medium on the medium supporting portion.

According to this aspect, the pressing surface of the pressing portion is movable between the first position in the retracted state and the second position for pressing the medium that is a position closer to the support surface than the first position. The pressing portion is disposed at the first position retracted when the medium is transported to the medium supporting portion. By setting the first position appropriately by grasping the degree of the curl in advance, the medium can be smoothly received by the medium supporting portion even when the medium being transported has a curl.

Further, after the aligning portion aligns the medium on the medium supporting portion, the pressing portion is disposed at the second position for pressing the medium. Accordingly, when the medium transported to the support surface of the medium supporting portion is curled, for the medium having a curl that is large enough to come into contact with the pressing surface at the second position, the curl can be reduced or almost eliminated by the pressing portion coming to the second position and pressing the medium. Further, when the curl is in the process of growing, it is possible to suppress the growth of the curl by pressing with the pressing portion. As a result, it is possible to reduce the risk of hindering the transport and stacking of the medium.

A second aspect of the present disclosure provides the processing device according to the first aspect in which, when a distance between the stacking surface in a state in which the stacking portion is located at an uppermost position and the medium supporting portion is a first distance and a distance between the pressing surface at the second position and the support surface is a second distance, the second distance is shorter than the first distance.

Here, the "uppermost position" in the "state in which the stacking portion is located at an uppermost position" refers to the position of the stacking surface of the stacking portion when receiving the first drop of the medium from the medium supporting portion.

According to this aspect, the second distance corresponding to the height when the medium is pressed is shorter than the first distance corresponding to the height of the stacking area of the stacking portion. That is, the pressing portion presses the medium on the support surface so as to be shorter than the distance between the stacking surface and the medium supporting portion, that is, the first distance. As a result, the height of the medium pressed by the pressing portion and dropped on the stacking portion becomes equal to or shorter than the first distance, and thus it is possible to reduce the risk of coming into contact with the medium supporting portion.

A third aspect of the present disclosure provides the processing device according to the second aspect in which, after the medium drops from the medium supporting portion, the stacking portion moves down a distance corresponding to a height of the dropped medium in a stacking direction.

Here, the "height of the dropped medium in a stacking direction" means the height of the uncurled portion of the medium in the stacking direction.

Exact match is not required for the "corresponding distance" in the "distance corresponding to a height of the dropped medium in a stacking direction".

According to this aspect, after the medium drops from the medium supporting portion, the stacking portion moves down a distance corresponding to a height of the dropped medium in a stacking direction. As a result, the height of the stacking area of the stacking portion does not change even when the medium is stacked on the stacking portion and the stacking amount increases, and can be maintained substantially constant.

A fourth aspect of the present disclosure provides the processing device according to any one aspect of the first aspect to third aspect further including a medium mounting portion having a mounting surface configured to support a rear end portion of the transported medium, in which the medium mounting portion is disposed such that a rear end of the support surface in the transport direction is lower than a front end of the mounting surface in the transport direction, and when a distance between the pressing surface at the second position and the support surface is a second distance, a distance between the rear end of the support surface in a transport direction and the front end of the mounting surface in the transport direction is longer than the second distance.

According to this aspect, the medium mounting portion is disposed such that the rear end of the support surface in the transport direction is lower than the front end of the mounting surface in the transport direction. Accordingly, by pressing the bundle of media supported across the medium supporting portion and the medium mounting portion by the pressing portion, even when the medium has high stiffness, that is, high rigidity, the side shape of the medium can be easily deformed into a non-linear shape such as S-shape or Z-shape. By this deformation, the friction between the media can be reduced, and the aligning property of the aligning portion can be improved.

Further, when the medium has a weak stiffness, the deformation strengthens the stiffness, and when the medium is shift-moved in a direction intersecting the transport direction, the movement can be performed with good stability.

A fifth aspect of the present disclosure provides the processing device according to the fourth aspect further including a processing portion for processing the medium mounted on the medium mounting portion.

According to this aspect, the processing portion can perform processing such as stapling on the bundle of media in a well-aligned state.

A sixth aspect of the present disclosure provides the processing device according to the first aspect in which the medium supporting portion is provided as a pair so as to face each other in a width direction intersecting a transport direction in which the medium is transported, has a support surface that supports the medium, and supports an outer side of a center of the transported medium in the width direction, and the pair of medium supporting portions has an inclined portion that is inclined downward toward a center in the width direction on at least a portion of the support surface.

According to this aspect, the pair of medium supporting portions has an inclined portion that is inclined downward toward a center in the width direction on at least a portion of the support surface. That is, the support surface has an inclined portion that is inclined downward toward the center in the width direction. Since the influence of the friction can be reduced by the inclined portion, it is possible to suppress "drag" due to the magnitude of the friction in the related art, and it is possible to reduce the risk of the drop position being displaced in the width direction when the medium drops from the pair of medium supporting portions to the stacking portion.

Further, the distance between the support surface and the stacking portion is shortened by the inclined portion by the amount of the inclination. This makes it possible to shorten the dropping distance of the medium, thereby reducing the risk of the medium being displaced due to air resistance during the drop. The effect of the present disclosure is great when the medium bundle is a lightweight bundle composed of a small number of sheets.

According to a seventh aspect of the present disclosure, there is provided a control method of a processing device including a medium supporting portion having a support surface for supporting at least a front end portion of a transported medium, an aligning portion for aligning the medium supported by the medium supporting portion, a stacking portion provided vertically below the medium supporting portion, having a stacking surface on which the medium dropped from the medium supporting portion is stacked, and configured to move up and down, and a pressing portion having a pressing surface facing the support surface, the pressing surface being configured to move between a first position and a second position closer to the support surface than the first position, the control method of the processing device includes: disposing the pressing portion at the first position; transporting the medium to the medium supporting portion after the pressing portion is disposed at the first position; aligning the medium supported by the medium supporting portion with the aligning portion; and disposing the pressing portion at the second position after aligning the medium with the aligning portion.

According to this aspect, the same effect as that of the first aspect can be obtained.

An eighth aspect of the present disclosure provides the control method of the processing device according to the seventh aspect in which when a distance between the stacking surface in a state in which the stacking portion is located at an uppermost position and the medium supporting portion is a first distance, the pressing portion is disposed at the second position in which a distance between the pressing surface and the support surface is a second distance shorter than the first distance after aligning the medium with the aligning portion.

According to this aspect, the same effect as that of the second aspect can be obtained.

A ninth aspect of the present disclosure provides the control method of the processing device according to the eighth aspect, in which, after the medium drops from the medium supporting portion, the stacking portion moves down a distance corresponding to a height of the dropped medium in a stacking direction.

According to this aspect, the same effect as that of the third aspect can be obtained.

According to a tenth aspect of the present disclosure, there is provided a recording system including a recording device including a recording portion for performing recording on a medium and a discharging portion for discharging the medium from the recording portion; and a processing device including a medium introducing portion for introducing the medium discharged from the discharging portion, a medium supporting portion having a support surface for supporting at least a front end portion of the medium introduced and transported from the medium introducing portion, an aligning portion for aligning the medium supported by the medium supporting portion, a stacking portion provided vertically below the medium supporting portion, having a stacking surface on which the medium dropped from the medium supporting portion is stacked, and configured to move up and down, and a pressing portion having a pressing surface facing the support surface, the pressing surface being configured to move between a first position and a second position closer to the support surface than the first position, in which the pressing portion is disposed at the first position when the medium is transported to the medium supporting portion, and is disposed at the second position after the aligning portion aligns the medium on the medium supporting portion.

According to this aspect, the same effect as that of the first aspect can be obtained in the recording system including the recording device.

Embodiment

Embodiments of a processing device, a control method of the processing device, and a recording system will be specifically described below based on the drawings.

The XYZ coordinate system shown in each drawing is a rectangular coordinate system, and the X-axis direction is the width direction of the medium P and also the depth direction of each device. When the medium P is transported horizontally, the Y-axis direction is the length direction of the medium P and the width direction of each device. The Z-axis direction is the thickness direction or the stacking height direction when the medium P is mounted horizontally, and indicates the vertical direction or the height direction of each device.

Further, the Ya-axis direction indicates the transport direction or the paper discharge direction in the processing device of the present embodiment, and +Ya indicates the downstream when the medium P is transported or discharged. Further, −Ya indicates the upstream opposite to the above. Further, in the present embodiment, the Ya-axis direction is set to a direction in which the +Ya side has an upward inclination which is slightly higher in the Z-axis direction than the horizontal Y-axis direction.

Overall Configuration of Recording System

First, based on FIG. 1, an outline of an overall configuration of a recording system 1 including a processing device 4 according to an embodiment of the present disclosure will be described.

The recording system 1 of the present embodiment includes a recording device 2 including a recording portion 10 for performing recording on a medium P such as a printing paper and a second discharge path 13 which is a discharging portion for discharging the medium P on which recording is performed by the recording portion 10 and the processing device 4 including a medium introducing portion 40 for introducing the medium P discharged from the second discharge path 13 which is a discharging portion, a medium supporting portion 50 having a support surface 50*a* (FIG. 2) for supporting at least a front end portion 53 (FIG. 2) of the medium P introduced and transported from the medium introducing portion 40, a rear end aligning portion 38 for aligning the medium P supported by the medium supporting portion 50, here, aligning the rear end 59 of the medium P, a stacking portion 37 provided below the medium supporting portion 50 in a vertical direction Z, having a stacking surface 37*a* on which the medium P dropped from the medium supporting portion 50 is stacked, and configured to move up and down, and a pressing portion 51 having a pressing surface 51*a* facing the support surface 50*a* in which the pressing surface 51*a* is movable between a first position Q1 (FIG. 3) and a second position Q2 (FIG. 5) closer to the support surface 50*a* than the first position Q1.

The pressing portion 51 is disposed at the first position Q1 when the medium P is transported to the medium supporting portion 50, and is disposed at the second position Q2 after the rear end aligning portion 38 aligns the medium P on the medium supporting portion 50.

The medium supporting portion 50 is provided as a pair of movable medium supporting portions 50L and 50R so as to face each other in the medium width direction X intersecting the transport direction Ya in which the medium P passed through a processing portion 36 is transported, has the support surface 50*a* that supports the medium P, and supports the outside of the center of the transported medium P in the width direction X.

Specifically, in the present embodiment, the recording system 1 is configured as shown in FIG. 1 as an example and includes the recording device 2, an intermediate device 3, and the processing device 4 of the present embodiment, which will be described later, in order from the right side to the left side of FIG. 1. The processing device 4 of the present embodiment includes a paper discharge device 30.

The recording device 2, the intermediate device 3, and the processing device 4 are coupled to each other. The medium P supplied by the recording device 2 and recorded is introduced into the processing device 4 via the intermediate device 3 and continuously transported and discharged until the medium P is delivered to the stacking portion 37.

Hereinafter, a schematic configuration of each of the recording device 2, the intermediate device 3, and the processing device 4 will be described in order.

Outline of Recording Device

The recording device 2 is a multifunction machine including a printer portion 5 including a recording head (recording portion) 10 that performs recording by ejecting ink, which is an example of a liquid, onto recording paper that is an example of a medium P, and a scanner portion 6 that reads an image described on a document. Further, in the present embodiment, the printer portion 5 is configured as a so-called ink jet printer, and a line head that performs recording in the width direction X of the medium P at once is adopted as an example of the recording head 10.

Further, the medium storage cassette 7 is provided in a plurality of stages at a lower portion of the main body of the recording device 2. In these medium storage cassettes 7, a plurality of media P having different sizes are sorted according to size and individually stored.

Then, the medium P stored in the medium storage cassette 7 of each stage is sent to the recording area of the printer portion 5 in which the recording head 10 exists through a feeding path 11 shown by a solid line in the recording device 2 of FIG. 1, and a desired recording operation is performed. The medium P on which recording is performed by the recording head 10 is sent to one of a first discharge path 12 that discharges the medium P toward a discharge tray 8 provided above the recording head 10 as an example and the second discharge path 13 that discharges the medium P toward the processing device 4 of the present embodiment through the intermediate device 3 described below.

In FIG. 1, the first discharge path 12 is shown by a broken line, and the second discharge path 13 is shown by a dashed line.

Further, the printer portion 5 of the recording device 2 is also provided with a reversing path 14 indicated by a two-dot line. It is possible to perform double-sided recording in which recording on the front surface of the medium P is performed and then recording on the rear surface is continuously performed by reversing the medium P.

Although not shown, at each of the feeding path 11, the first discharge path 12, the second discharge path 13, and the reversing path 14, one or more transport roller pairs for applying a transport force to the medium P, and a guide roller or guide member for guiding the transport of the medium P are appropriately disposed.

In addition, the recording device 2 is provided with an operation panel (not shown) used for inputting various kinds of information relating to the transport and recording of the medium P and a control portion 15 that controls the various operations relating to the transport and recording of the medium P based on the various kinds of input information.

The operation panel and the control portion 15 may have a structure provided in each of the recording device 2, the intermediate device 3, and the processing device 4, or may have a structure provided only in the recording device 2 and controlling the entire of each device.

Outline of Intermediate Device

The intermediate device 3 is a device that receives the medium P after recording, which is discharged through the second discharge path 13, from the recording device 2 and delivers the medium P to the processing device 4.

The intermediate device 3 is provided with an intermediate receiving path 20 indicated by a solid line in FIG. 1 that receives the medium P after recording is performed which is discharged through the second discharge path 13 of the recording device 2, in the main body of the intermediate device 3.

Further, a branch portion 24 is provided at the end of the intermediate receiving path 20, and two transport paths for transporting the medium P from the branch portion 24 are provided. The first transport path is a transport path from the intermediate receiving path 20 to the intermediate discharge path 23 via the first switchback path 21.

The first switchback path 21 is a path that receives the medium P in an arrow A1 direction and then switches back the medium P in an arrow A2 direction to reach the intermediate discharge path 23. The second switchback path 22 is a path that receives the medium P in an arrow B1 direction and then switches back the medium P in an arrow B2 direction to reach the intermediate discharge path 23.

Therefore, a merging portion 25 is provided at the ends of the first switchback path 21 and the second switchback path 22 and is configured such that both the medium P sent to the first switchback path 21 and the medium P sent to the second switchback path 22 by the merging portion 25 are guided to the common intermediate discharge path 23 so that the medium P can be delivered to the processing device 4 having the paper discharge device 30 described later.

Although not shown, each of the intermediate receiving path 20, the first switchback path 21, the second switchback path 22, and the intermediate discharge path 23 has one or more transport roller pairs for applying a transport force to the medium P, and a guide roller or a guide member for guiding the transport of the medium P are appropriately disposed.

In addition, when recording is continuously performed on a plurality of media P, it is possible to alternately send the media P received in the intermediate device 3 to the transport path passing through the first switchback path 21 and the transport path passing through the second switchback path 22. With such a configuration, it is possible to increase the throughput of transporting the medium P in the intermediate device 3 and perform efficient intermediate transport.

In addition, when the medium P on which recording is performed by the recording device 2 is sent to the processing device 4 via the intermediate device 3, the transport time is longer than when the medium P is directly sent from the recording device 2 to the processing device 4. Therefore, it is possible to obtain the effect of promoting the drying of the ink ejected onto the front surface or the rear surface of the medium P before being transported to the processing device 4.

When it is not necessary to accelerate the drying of the ink, the intermediate device 3 may be omitted and the recording system 1 may be provided with only the recording device 2 and the processing device 4.

Outline of Processing Device

The processing device 4 is, for example, a device that bundles a plurality of media P on which recording is performed by the recording device 2 and drying is promoted by the intermediate device 3 into a bundle, performs a predetermined process after alignment, and sequentially discharges and stacks the sheets on the stacking portion 37.

Along with this, the processing device 4 is provided with a transport element that transports the medium P to guide the medium P delivered from the intermediate device 3 into the main body of the processing device 4 for aligning and discharging, an aligning element that aligns a plurality of transported media P into a bundle, a processing element that performs a predetermined process such as a stapling process on the aligned medium P, and a paper discharge and stacking element that discharges the processed medium P and sequentially stacks the media P.

In the present embodiment, the transport element includes a transport path 31, a first transport roller pair 32, a second transport roller pair 33, a medium transport portion 34, and a medium mounting portion 35. Further, the aligning element includes the rear end aligning portion 38, a paddle mechanism 43 (FIG. 2), and a second side end aligning portion 41. The processing element includes the processing portion 36 such as a stapling process, punching process, bending process, and saddle stitch process. The paper discharge and stacking element includes the paper discharge device 30, the medium supporting portion 50, and the stacking portion 37.

Further, in the present embodiment, a pressing element is provided to suppress the occurrence of curls such as a lateral curl in which the front end 56 of the medium P generated due to swelling or transport caused by performance of recording in the recording device 2 are curved upward, a longitudinal curl in which the left and right side ends 57L and 57R of the front end portion 53 of the medium P are curved upward, and a curl due to swelling in which the central portion of the medium P bulges upward due to swelling with ink. The pressing element includes the pressing portion 51 and the medium supporting portion 50.

The transport path 31 that guides the medium P delivered to the processing device 4 into the main body of the device so as to perform a predetermined transport is provided at the introducing portion of the processing device 4. In addition, on the transport path 31, two transport roller pairs, that is, a first transport roller pair 32 and a second transport roller pair 33, which apply a transport force to the medium P introduced into the main body of the device, are provided as an example.

Hereinafter, a specific configuration of the processing device 4 of the present embodiment configured by these respective elements will be described in detail.

Specific Configuration of Processing Device

The processing device 4 according to the present embodiment includes the medium supporting portion 50 having a support surface 50*a* for supporting at least a front end portion 53 of the transported medium P, the rear end aligning portion 38 for aligning the medium P supported by the medium supporting portion 50, the stacking portion 37 provided below the medium supporting portion 50 in the vertical direction Z, having the stacking surface 37*a* on which the medium P dropped from the medium supporting portion 50 is stacked, and configured to move up and down, and the pressing portion 51 having the pressing surface 51*a* facing the support surface 50*a* in which the pressing surface 51*a* is movable between the first position Q1 and the second position Q2 closer to the support surface 50*a* than the first position Q1.

The pressing portion 51 is disposed at the first position Q1 when the medium P is transported to the medium supporting portion 50, and is disposed at the second position Q2 after the rear end aligning portion 38 aligns the medium P on the medium supporting portion 50.

The medium supporting portion 50 is provided as a pair of movable medium supporting portions 50L and 50R so as to face each other in the medium width direction X intersecting the transport direction Ya in which the medium P passed through the processing portion 36 is transported, has the support surface 50*a* that supports the medium P, and supports the outside of the center of the transported medium P in the width direction X.

Further, in the present embodiment, the medium mounting portion 35 having the mounting surface 35*a* capable of supporting the rear end portion 55 of the medium P transported from the intermediate device 3 is located at the upstream −Ya position of the medium supporting portion 50 in the transport direction Ya. Further, above the medium mounting portion 35, the medium transport portion 34 having the paddle mechanism 43 for assisting the operation of the rear end aligning portion 38 is provided.

Further, since the medium supporting portion 50 and the stacking portion 37 stack and hold the medium P to be discharged after alignment and processing, it can be said that the medium supporting portion 50 and the stacking portion 37 also serve as constituent members of the paper discharge device 30. Hereinafter, the constituent members of the above-described respective elements constituting the processing device 4 will be specifically described.

Transport Element

As shown in FIG. 1, the transport element of the processing device 4 is configured of the transport path 31, the first transport roller pair 32, the second transport roller pair 33, the medium transport portion 34, and the medium mounting portion 35.

In the present embodiment, as shown in FIG. 1, the transport path 31 is disposed horizontally in the medium introducing portion 40 in parallel with the Y direction, and the transport path 31 is disposed as an upwardly inclined transport path 31 along the transport direction Ya corrected upward from the portion where the medium transport portion 34 and the medium mounting portion 35 are disposed.

The first transport roller pair 32 composed of a pair of nip rollers is provided at an upstream position (−Y direction) of the horizontal portion of the transport path 31, and the second transport roller pair 33 also composed of a pair of nip rollers is provided at a downstream position (+Y direction) of the horizontal portion.

The medium transport portion 34 transports the bundle of aligned and processed media P from the position where the rear end portion 55 is located on the mounting surface 35*a* of the medium mounting portion 35 to the support surface 50*a* of the medium supporting portion 50.

The medium transport portion 34 includes a swing frame 63 that swings about a swing fulcrum O by a predetermined angle. At the corner of the lower surface of the swing frame 63 at the downstream position, a transport driven roller 62 that comes into contact with the upper surface of the bundle of media P and applies a transport force toward the downstream +Ya in the transport direction to the medium P by a nip action with a transport drive roller 61 described later is provided. The paddle mechanism 43 for assisting alignment, which will be described later, is also mounted on the medium transport portion 34.

The medium transport portion 34 can also adopt a transport section having a configuration in which a transport belt wound around a plurality of rollers disposed in a loop is used as an example instead of the above-described combination of the transport drive roller 61 and the transport driven roller 62, and a suction and adsorption type or an electrostatic adsorption type adsorption section using the negative pressure generated by a suction fan is used together.

The medium mounting portion 35 is a member that supports the rear end portion 55 of the medium P guided to the transport path 31 so that the aligning work described below can be smoothly performed.

The medium mounting portion 35 has a housing 65 having a mounting surface 35*a* inclined along the paper discharge direction Ya at the upper surface. The transport drive roller 61 that forms a nip roller together with the transport driven roller 62 described above and applies a transport force to the medium P is provided at a corner portion of the upper portion of the housing 65 at the downstream position. In addition, in the housing 65, a motor and a power transmission section (not shown) for applying a driving force to the transport drive roller 61, and a moving section for moving the rear end aligning portion 38 described later to the downstream +Ya or upstream −Ya in the paper discharge direction Ya where the medium supporting portion 50 exists.

Aligning Element

The aligning element of the processing device 4 is configured by including the rear end aligning portion 38, a first side end aligning portion (not shown), the paddle mechanism 43, and the second side end aligning portion 41. Further, there are the support surface 50*a* of the medium supporting portion 50 and the mounting surface 35*a* of the medium mounting portion 35 as portions that support the medium P from below when the medium P is aligned.

Figure 2:
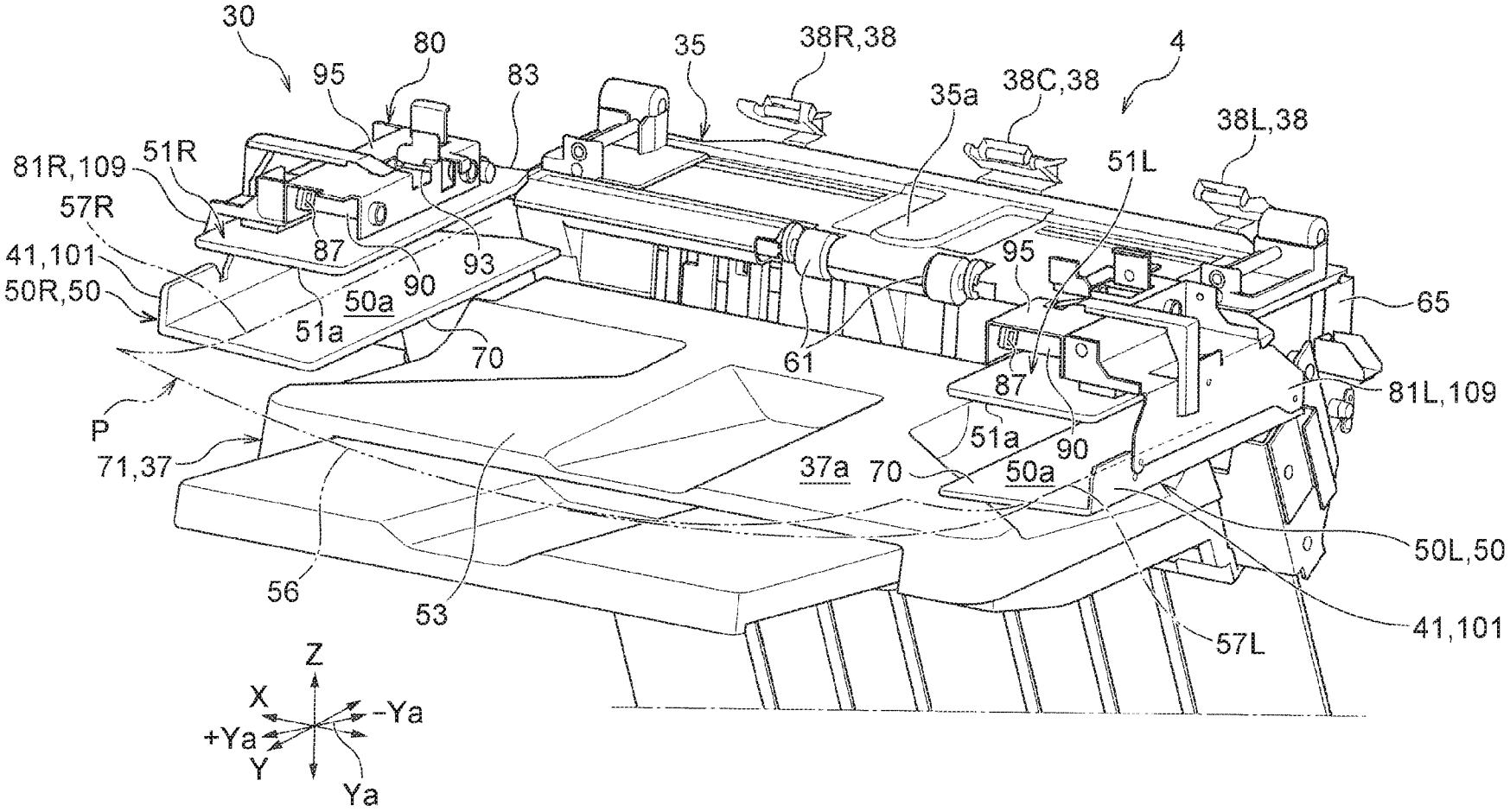
FIG. 2 is a perspective view showing a processing device of the present embodiment.

The rear end aligning portion 38 is a portion that arranges and aligns rear ends 59 of a bundle of a plurality of media P supported by the mounting surface 35*a* of the medium mounting portion 35. The rear end aligning portion 38 is a member having a substantially U-shaped cross section with an open end surface on the downstream +Ya in the paper discharge direction Ya. In the present embodiment, the rear end aligning portion 38 is provided with three pairs of rear end aligning portions 38L, 38R, and 38C, one set each on the left and right sides and the center of the medium width direction X (FIG. 2).

A pair of left and right first side end aligning portion is provided so as to sandwich the medium P on the medium mounting portion 35 from the medium width direction X, and is configured to be able to perform a shift operation of a predetermined stroke in the medium width direction X. Thereby, the side of the medium P, which is supported by the mounting surface 35*a* of the medium mounting portion 35, on the rear end 59 side can be aligned.

The support surface 50*a* of the medium supporting portion 50 and the mounting surface 35*a* of the medium mounting portion 35 are inclined surfaces to assist the rear end 59 of the medium P to smoothly enter and be held in the rear end aligning portion 38. The medium P is arranged and aligned by the rear end 59 of the medium P being smoothly guided into the rear end aligning portion 38 by sliding down the support surface 50*a* and the mounting surface 35*a*, which are the inclined surfaces, by its own weight and coming into contact with the bottom surface of the rear end aligning portion 38.

Further, there is the paddle mechanism 43 as a mechanism for assisting the movement of the medium P by its own weight.

The paddle mechanism 43 includes a rotation shaft 45 extending in the medium width direction X, a plurality of blades called paddles 47, which are provided around the rotation shaft 45 and are made of a rubber material, and a drive section for rotationally driving the rotation shaft 45 in a direction in which the rear end 59 of the medium P enters the rear end aligning portion 38. Further, two sets of paddles 47 constituted by a plurality of blades are disposed at positions apart from each other in the medium width direction X, and are provided so as to be movable in the medium width direction X.

The first side end aligning portion and the second side end aligning portion 41 are disposed on the left and right sides of the medium transport portion 34 and the medium mounting portion 35 so as to sandwich them. The both aligning portions arrange and align the left and right side ends 57 of the bundle of the media P by performing a shift operation of a predetermined stroke in the medium width direction X by a shift mechanism (not shown).

The second side end aligning portion 41 is a member that constitutes the medium supporting portion 50, as will be described later. A pair of left and right medium supporting portions 50 is provided so as to sandwich the medium P in the medium width direction X, and is configured to be able to perform a shift operation of a predetermined stroke in the medium width direction X by a shift mechanism (not shown). Accordingly, the side ends 57L and 57R (FIG. 2), which are mainly the sides of the front end portion 53 of the medium P supported by the support surface 50*a* of the medium supporting portion 50 are aligned with each other.

Processing Element

The processing element of the processing device 4 includes the processing portion 36 that performs a predetermined process on the medium P mounted on the medium mounting portion 35.

Figure 3:
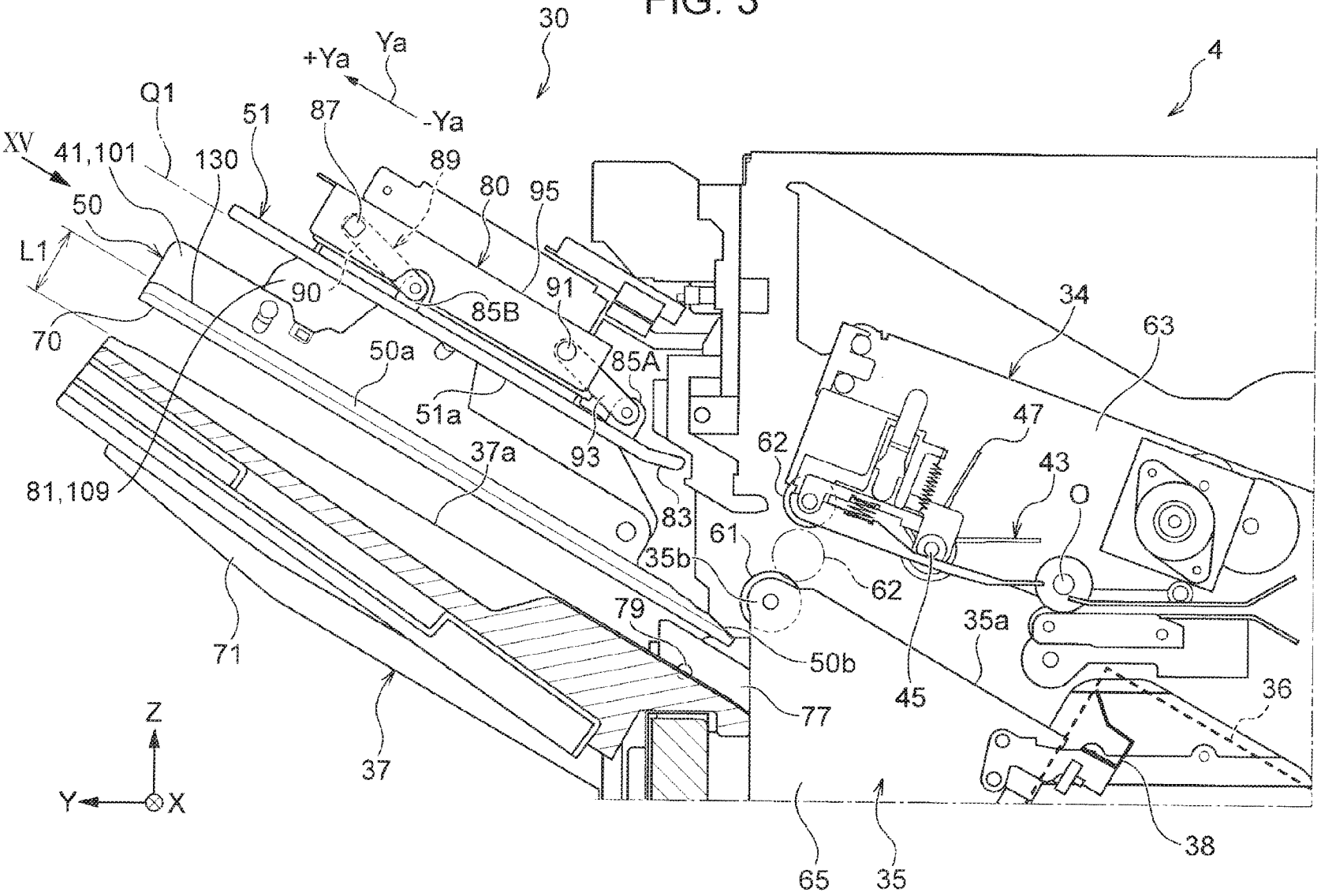
FIG. 3 is a side sectional view showing the processing device of the present embodiment before receiving a medium.

The processing portions 36 shown in FIGS. 1 and 3 are provided as an example at the three positions, left and right corners and the center at the rear end 59 of the medium P. As described above, predetermined process such as the stapling process, the punching process, and the bending process, and saddle stitching process is performed.

In the present embodiment, as one example, a configuration is adopted in which a binding needle (not shown) is driven into one of the above-described three positions of the rear end 59 of the medium P to perform the stapling process. Along with this, the processing portion 36 is appropriately provided with a storage portion that can store a plurality of binding needles, a mechanism that feeds the binding needles to the binding position, and a mechanism that drives the binding needles.

Paper Discharge and Stacking Element

The paper discharge and stacking element of the processing device 4 is configured by including the paper discharge device 30, the medium supporting portion 50, and the stacking portion 37 as described above.

Figure 8:
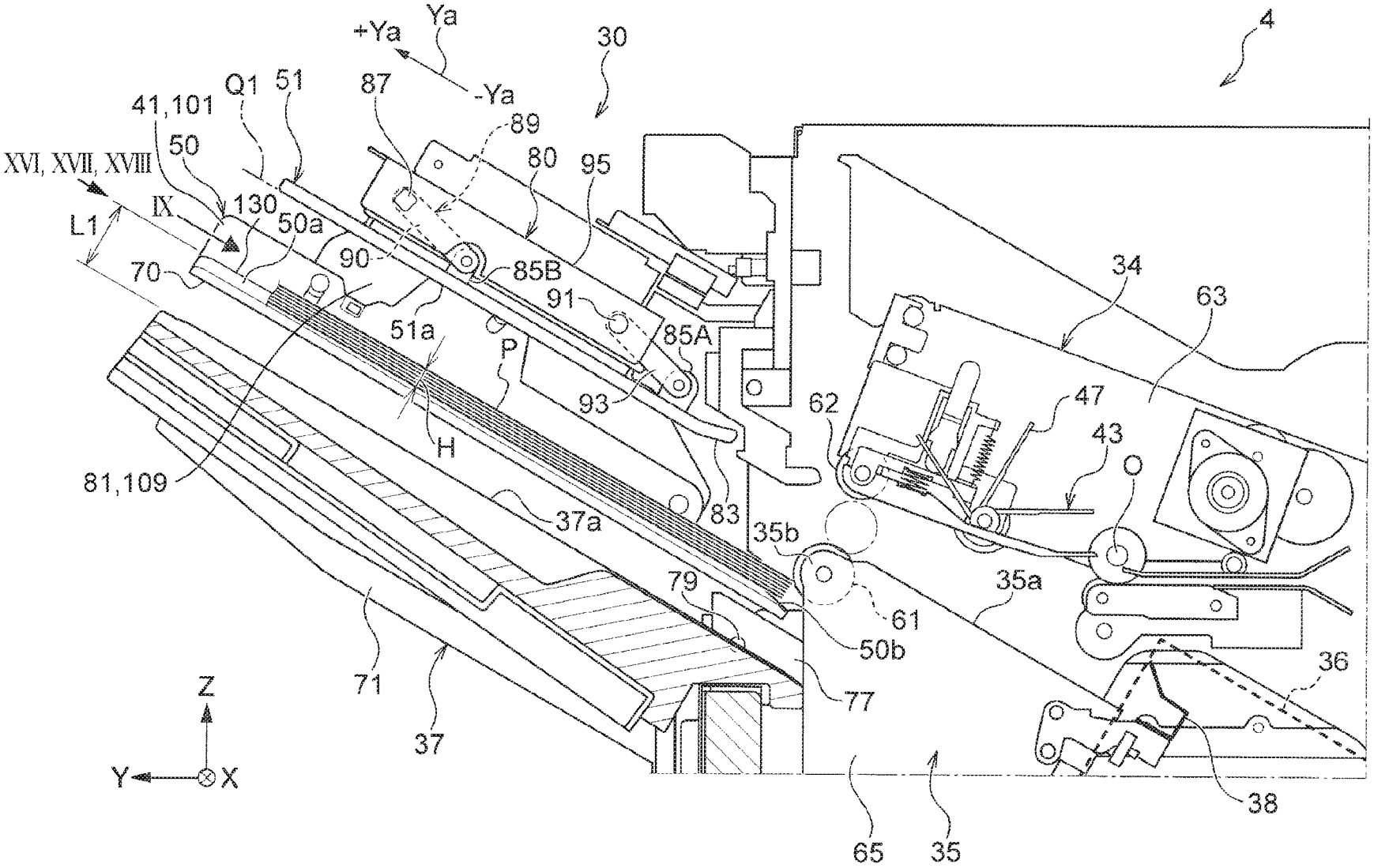
FIG. 8 is a side sectional view showing the processing device of the present embodiment after discharging a medium.

The paper discharge device 30 is a device that transfers the bundle of the media P processed by the processing portion 36, the rear end portion 55 of which is supported by the mounting surface 35*a* of the medium mounting portion 35, to the downstream +Ya in the paper discharge direction Ya and positions the rear end portion 55 of the medium P on the support surface 50*a* of the medium supporting portion 50 (FIG. 8).

Specifically, the paper discharge device 30 is configured by including the medium transport portion 34 and the medium mounting portion 35 that form the transport element elements described above.

The medium supporting portion 50 is a medium support member in which a lower support portion 70 whose an upper surface serves as a support surface 50*a* and a second side end aligning portion 41 whose inner wall surface serves as a restriction surface when aligning the side ends 57L and 57R (FIG. 2) of the medium P are integrally formed and have an L-shaped cross section as an example. The medium supporting portion 50 is provided in an inclined posture in which the downstream +Ya along the paper discharge direction Ya is higher and the medium supporting portion 50 is inclined upward.

The medium supporting portions 50 are disposed facing each other on the right and left sides in the medium width direction X, and are configured to be able to perform a shift operation of a predetermined stroke in the medium width direction X as an example.

Specifically, in the state where the medium supporting portion 50 supports the medium P, the left and right medium supporting portions 50L and 50R both shift inward to support the lower surface near the side ends 57L and 57R of the medium P. On the other hand, when the support of the medium P is released and the bundle of media P is dropped onto the stacking surface 37*a* of the lower stacking portion 37, the left and right medium supporting portions 50L and 50R both shift outward and move to the outside of the area where the medium P exists, and the medium P is dropped.

The stacking portion 37 includes a paper discharge tray 71 that can be moved up and down to receive a bundle of the media P that the support by the medium supporting portion 50 is released and dropped downward in the vertical direction Z.

The stacking surface 37*a* of the paper discharge tray 71 provided in an inclined posture in which the downstream +Ya along the paper discharge direction Ya is higher and the medium supporting portion 50 is inclined upward, like the medium supporting portion 50. In the state in which the paper discharge tray 71 is located at the uppermost position shown in FIG. 3, the paper discharge tray 71 is configured to always maintain the first distance L1 between the stacking surface 37*a* and the medium supporting portion 50, and to stand by at the lower position thereof.

A sensor 79 is provided at the housing 77 on the side of the base of the paper discharge tray 71 when the paper discharge tray 71 is located at the uppermost position. Then, normally, when a bundle of media P is dropped onto the stacking surface 37*a* of the paper discharge tray 71, the sensor 79 detects the presence of the medium P, and the paper discharge tray 71 moves downward in the vertical direction Z by the stacking height H of the bundle of dropped media P. As a result, when the support by the medium supporting portion 50 is released and the bundle of the media P is dropped, the distance D of the drop is maintained substantially constant.

Pressing Element

As shown in FIGS. 2, 3, and the like, the pressing element of the processing device 4 includes, above the medium supporting portion 50, the pressing portion 51 provided in an inclined posture in which the downstream +Ya along the paper discharge direction Ya is higher and the medium supporting portion 50 is inclined upward, a pressing mechanism 80 for pressing the pressing portion 51 against the medium supporting portion 50 side, and holding frames 81R and 81L (FIG. 2) bent into an L shape as an example of holding these in a state of being coupled to the medium supporting portion 50, similar to the medium supporting portion 50.

The pressing portion 51 is disposed in parallel with the medium supporting portion 50 and is a flat plate-like member that is slightly smaller than the lower support portion 70 of the medium supporting portion 50. The pressing portion 51 has an inclined guide 83 that is bent upward so that the medium P can be smoothly transported and discharged at the upstream −Ya end in the paper discharge direction Ya.

Further, coupling pieces 85A and 85B (FIG. 3) which are raised upward are provided at a downstream +Ya position near the inclined guide 83 of the pressing portion 51 and a position further downstream +Ya separated by a predetermined distance. The pressing portion 51 is coupled to the pressing mechanism 80 described below via these coupling pieces 85A and 85B.

The pressing mechanism 80 includes a motor (not shown) serving as a drive source, a power transmission mechanism (not shown) that transmits the rotation of the output shaft of the motor to a drive shaft 87, and a power conversion mechanism 89 for converting the rotation of the drive shaft 87 into an approaching/separating operation of the pressing portion 51 with respect to the support surface 50*a* of the medium supporting portion 50.

Further, the power conversion mechanism 89 is configured by a parallel link mechanism in the present embodiment. Specifically, the power conversion mechanism 89 includes a first link arm 90, one end of which is fixedly coupled to the drive shaft 87 and the other end of which is rotatably coupled to the coupling piece 85B at the downstream +Ya position, a second link arm 93 having the same length as the first link arm 90, one end of which is pivotably coupled to a turning pivot 91 provided at a position separated from the drive shaft 87 on the upstream −Ya and the other end of which is rotatably coupled to the coupling piece 85A at the upstream −Ya position, and a support frame 95 having a gate shape as an example of pivotally supporting the drive shaft 87 and the turning pivot 91 and supporting the motor and the power transmission mechanism (not shown).

As a result, when the rotation of the output shaft of the motor (not shown) is transmitted to the drive shaft 87 via the power transmission mechanism, the first link arm 90 and the second link arm 93 pivot on the drive shaft 87 and the turning pivot 91, respectively, clockwise or counterclockwise in FIG. 3 while maintaining the parallel state.

The turns of the first link arm 90 and the second link arm 93 are transmitted to the pressing portion 51 via the two coupling pieces 85A and 85B coupled to the other end side, and the pressing surface 51*a* of the pressing portion 51 is movable between the first position Q1 which is the retracted position and the second position Q2 which is the pressing position closer to the support surface 50*a* than the first position Q1 while maintaining the parallel state of the pressing portion 51 and the medium supporting portion 50.

Further, in the present embodiment, when the distance between the stacking surface 37*a* in the state where the paper discharge tray 71 of the stacking portion 37 is located at the uppermost position and the medium supporting portion 50 is the first distance L1 as described above, and the distance between the pressing surface 51*a* in the state where the pressing portion 51 is located at the second position Q2 and the support surface 50*a* is the second distance L2, the second distance L2 is set to be shorter than the first distance L1.

Further, in the present embodiment, after the support by the medium supporting portion 50 is released and the bundle of media P is dropped downward, the distance D by which the paper discharge tray 71 of the stacking portion 37 is lowered is set to be a distance corresponding to the height H of the bundle of the dropped media P in the stacking direction.

Further, in the present embodiment, the height position of the medium mounting portion 35 in the vertical direction Z is set to have a stepped disposal such that the height of the rear end 50*b* of the support surface 50*a* of the medium supporting portion 50 in the transport direction Ya is lower than the height of the front end 35*b* of the mounting surface 35*a* of the medium mounting portion 35 in the transport direction Ya.

Furthermore, the distance between the rear end 50*b* of the support surface 50*a* of the medium supporting portion 50 in the transport direction Ya and the front end 35*b* of the mounting surface 35*a* of the medium mounting portion 35 in the transport direction Ya is set to be longer than the second distance L2.

Specific Configuration of Paper Discharge Device

Figure 15:
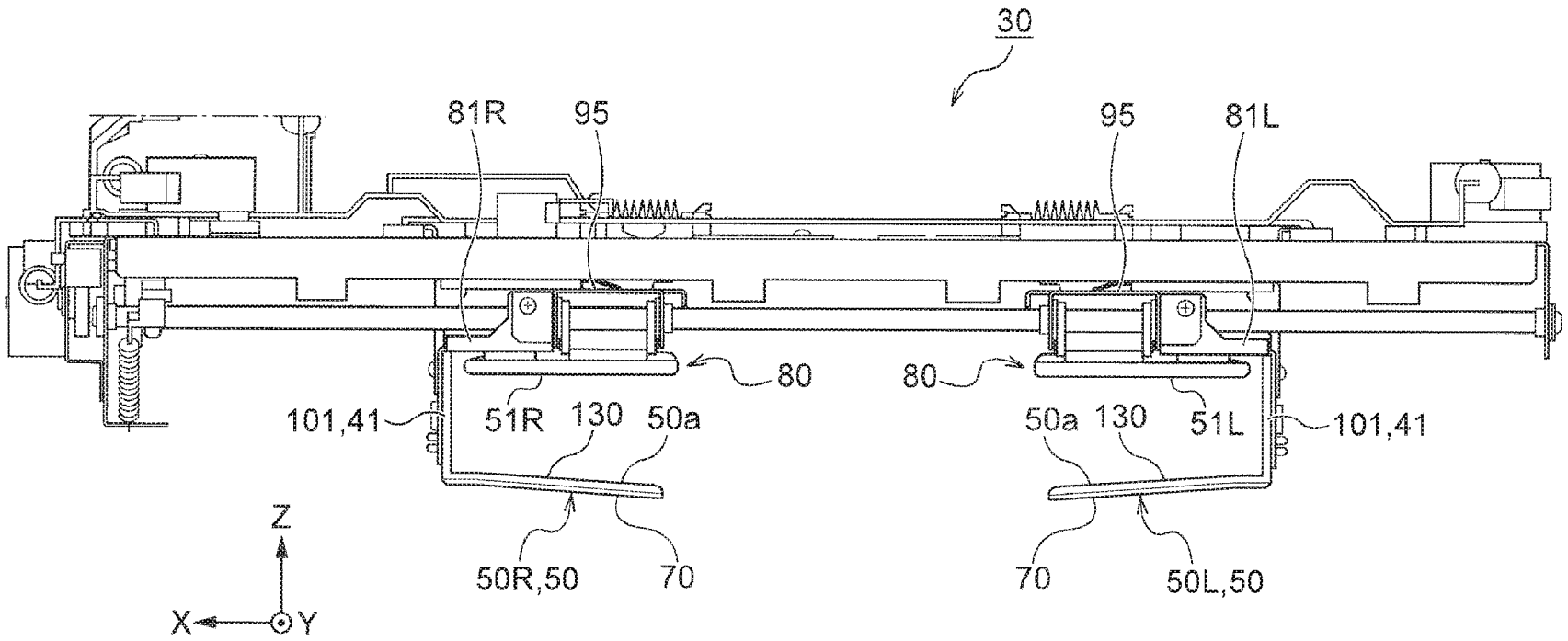
FIG. 15 is a view showing a medium supporting portion of the processing device of the present embodiment as viewed from a direction of arrow XV in FIG. 3.

As shown in FIGS. 2, 3, 15, and the like, the paper discharge device 30 of the present embodiment is provided with a pair of movable medium supporting portions 50L and 50R so as to face each other in the medium width direction X intersecting the transport direction Ya in which the medium P is transported, having the support surface 50*a* that supports the medium P, and the support surface 50*a* supports the outer side of the center of the transported medium P in the width direction X, and the stacking portion 37 that is provided below the pair of medium supporting portions 50L and 50R in the vertical direction Z and on which the medium P dropped from the pair of medium supporting portions 50L and 50R are stacked.

The pair of medium supporting portions 50L and 50R has an inclined portion 130 that is inclined downward toward the center in the medium width direction X on at least a portion of the support surface 50*a*.

Structure of Medium Supporting Portion: Inclined Portion

Since the basic configuration of the medium supporting portion 50 has already been described, the shape of the lower support portion 70, which is a characteristic configuration of the paper discharge device 30 of the present embodiment, will be described here.

Figure 21:
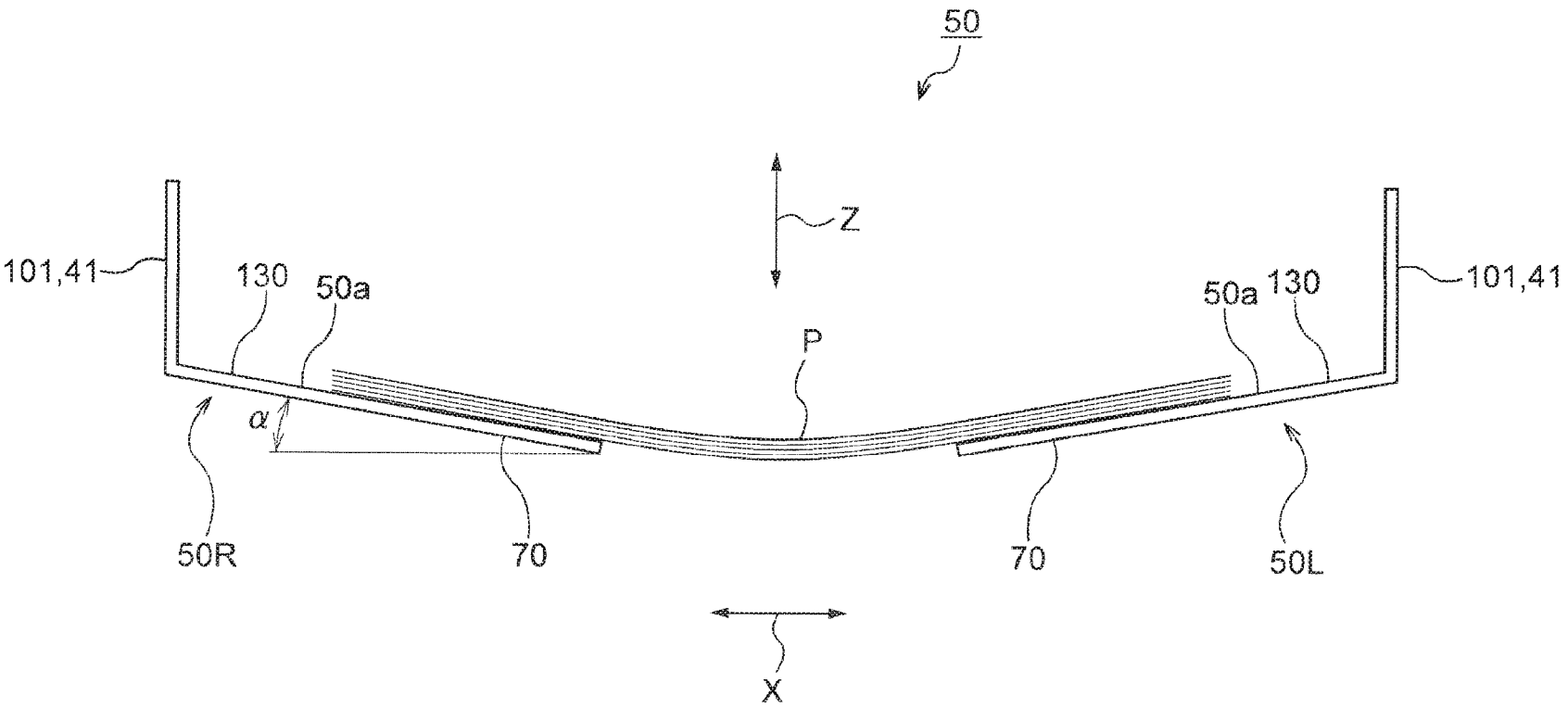
FIG. 21 is a front view showing another example of the shape of the medium supporting portion of the processing device of the present embodiment.

As schematically shown in FIG. 21, in the embodiment shown in FIGS. 1 to 18, the inclined portion 130 is provided in the entire area of the lower support portion 70 or almost in the entire area thereof. The inclination angle α of the inclined portion 130 with respect to the horizontal is an angle at which the supporting state can be maintained as it is when the medium P is supported. Furthermore, when the support of the medium P is released, the inclination angle α is an angle at which the medium P can be smoothly dropped downward in the vertical direction Z without being pulled to one side due to the influence of the friction force between the medium P and the support surface 50*a*.

In the present embodiment, the inclination angle α of the lower support portion 70 with respect to the horizontal is set to approximately 5° to 10° as an example. Further, it is desirable that the inclination angles α of the lower support portions 70 are set to be the same between the left and right lower support portions 70 so that the medium P can surely drop downward in the vertical direction Z when the support of the medium P is released.

Figure 19A:
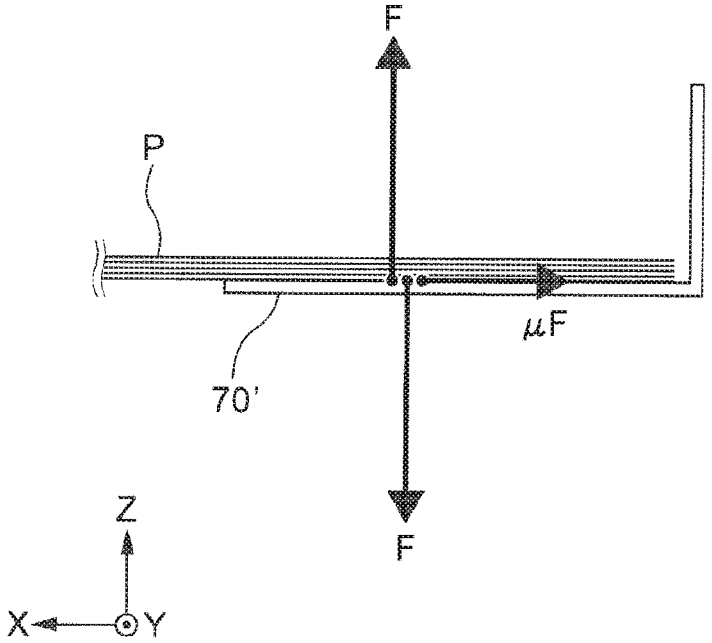
FIGS. 19A and 19B are schematic diagrams showing a relationship of forces applied to a medium supporting portion of the processing device of the present embodiment during medium support.
Figure 19B:
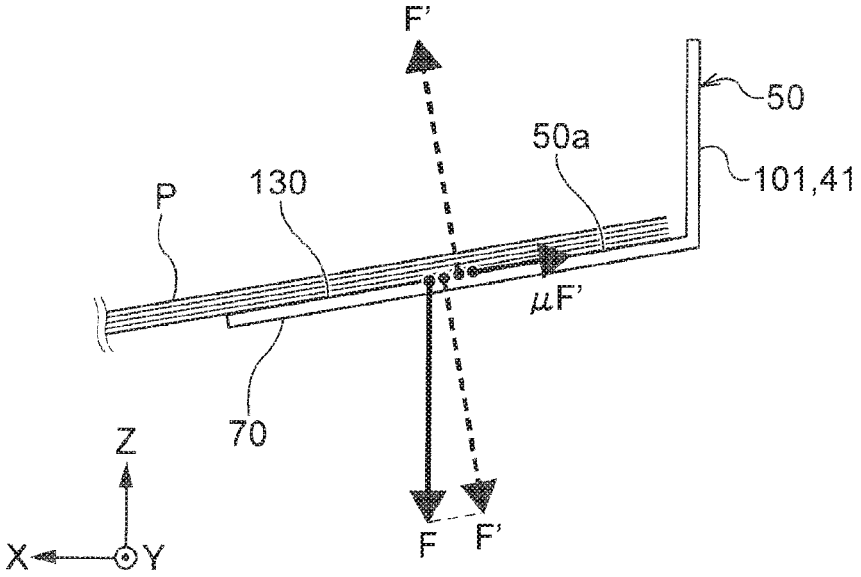

FIGS. 19A and 19B show the relationship of the forces applied to the lower support portion 70 of the medium supporting portion 50 when supporting the medium P. In FIGS. 19A and 19B, F indicates the force in the vertical direction Z (or its reaction force) in which the load of the medium P is applied to the contact surface of the lower support portion 70. F' indicates the vertical direction component of F (or its reaction force). μ is a dynamic friction coefficient. Here, in FIGS. 19A and 19B, FIG. 19A shows a lower support portion 70' of the related art when the inclined portion 130 is not provided, and FIG. 19B shows the lower support portion 70 of the present embodiment when the inclined portion 130 is provided in the lower support portion 70.

As is clear from FIGS. 19A and 19B, the friction force is μF in the lower support portion 70' of the related art, and the friction force is μF' in the lower support portion 70 of the present embodiment, and μF>μF'. As a result, in the configuration of the lower support portion 70 of the present embodiment, the friction force between the support surface 50*a* of the lower support portion 70 and the lower surface of the medium P is smaller than that in the configuration of the lower support portion 70' of the related art. Therefore, even with respect to the separating operation accompanying the opening of the medium supporting portion 50, the configuration of the present embodiment is less likely to bring the medium P to one side of the medium supporting portion 50 than the configuration of the related art.

Inclined Portion and Flat Portion

Figure 20:
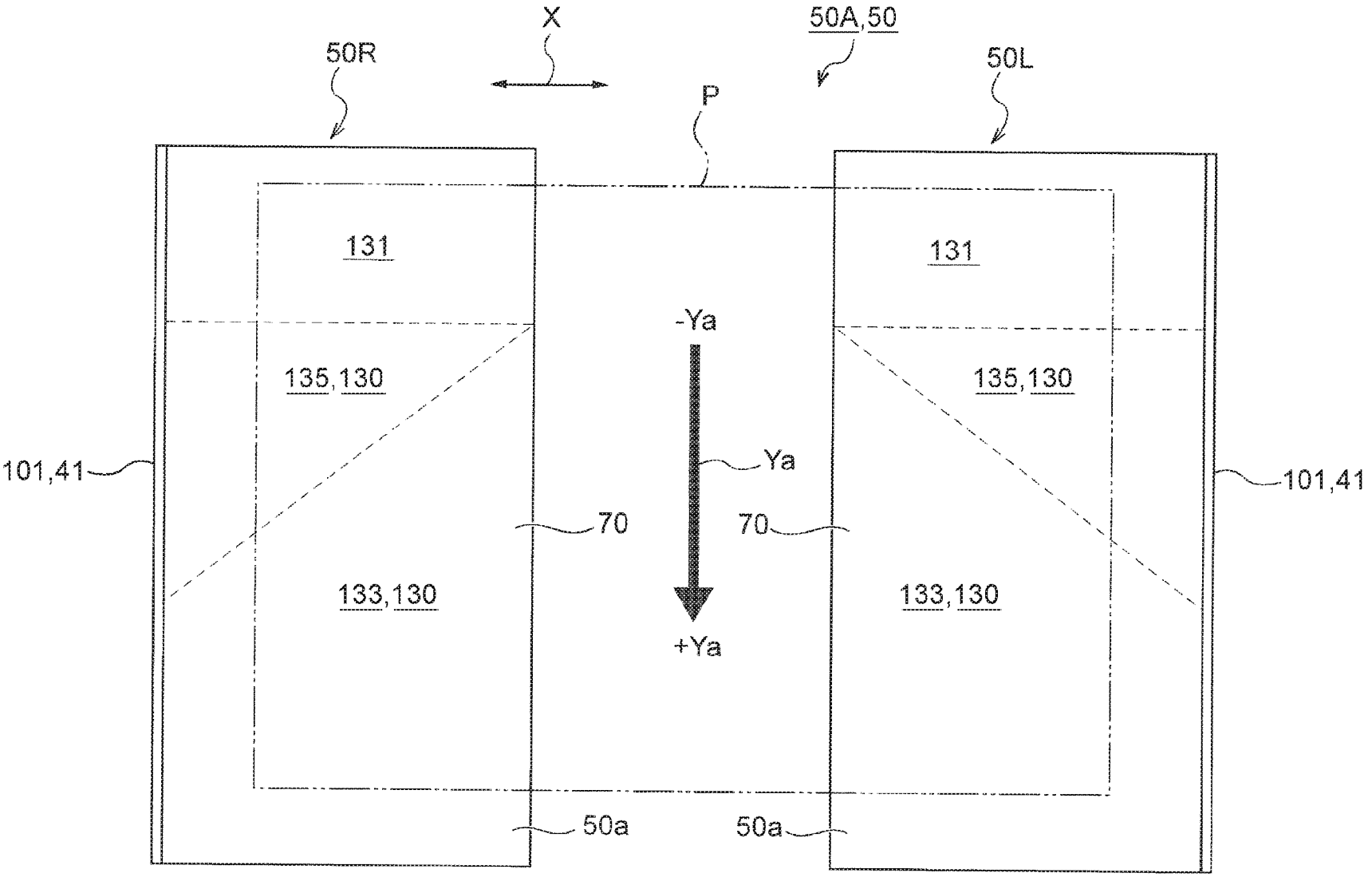
FIG. 20 is a plan view showing an example of a shape of the medium supporting portion of the processing device of the present embodiment.

Further, as shown in FIG. 20, the inclined portion 130 may be provided on at least a part of the support surface 50*a* of the medium supporting portion 50 in the transport direction Ya.

FIG. 20 shows a medium supporting portion 50A according to a modification example in which the support surface 50*a* of the lower support portion 70 in the medium supporting portion 50 is divided into two areas in the transport direction Ya, one area of which is a flat portion 131 and the remaining area is the inclined portion 130.

Further, in the medium supporting portion 50A, the area of the inclined portion 130 is further divided into two, one of which is a final inclined portion 133 having the inclination angle α, and the remaining area is an intermediate inclined portion 135 that couples the flat portion 131 and the final inclined portion 133.

Also in the medium supporting portion 50A according to the present modification example, it is desirable that the shapes and inclination angles α of the inclined portions 130 in the lower support portions 70 are set to be the same between the left and right lower support portions 70 so that the medium P can surely drop downward in the vertical direction Z when the support of the medium P is released.

Further, in the present modification example, since the flat portion 131 and the inclined portion 130 are separately disposed in the transport direction Ya of the medium P, when the support of the medium P is released, the shape of the inclined portion 130 and the inclination angle α are appropriately adjusted so that a vector that moves in the transport direction Ya with respect to the medium P does not occur.

Figure 22:
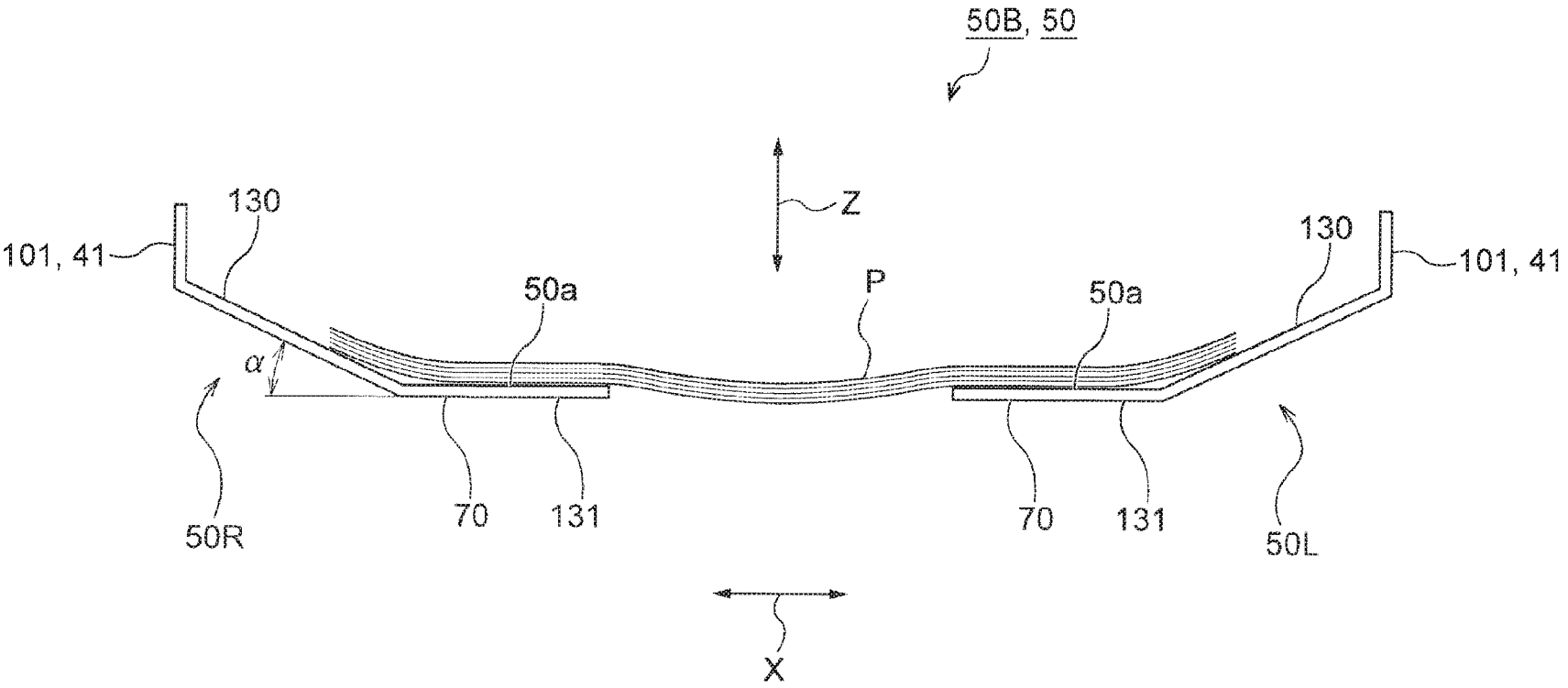
FIG. 22 is a front view showing another example of the shape of the medium supporting portion of the processing device of the present embodiment.

Further, as shown in FIG. 22, the inclined portion 130 can be provided on at least a part of the support surface 50*a* of the medium supporting portion 50 in the width direction X.

FIG. 22 shows a medium supporting portion 50B according to the modification example in which the support surface 50*a* of the lower support portion 70 in the medium supporting portion 50 is divided into two areas in the width direction X, in which the inclined portion 130 coupled to a side plate 101 is disposed on the outer side and the flat portion 131 is disposed on the inner side.

Also in the present modification example, it is desirable that the inclination start positions, areas, and inclination angles α of the inclined portions 130 in the lower support portions 70 are set to be the same between the left and right lower support portions 70 so that the medium P can surely drop downward in the vertical direction Z when the support of the medium P is released.

Inclined Portion and Gently Inclined Portion

Figure 23:
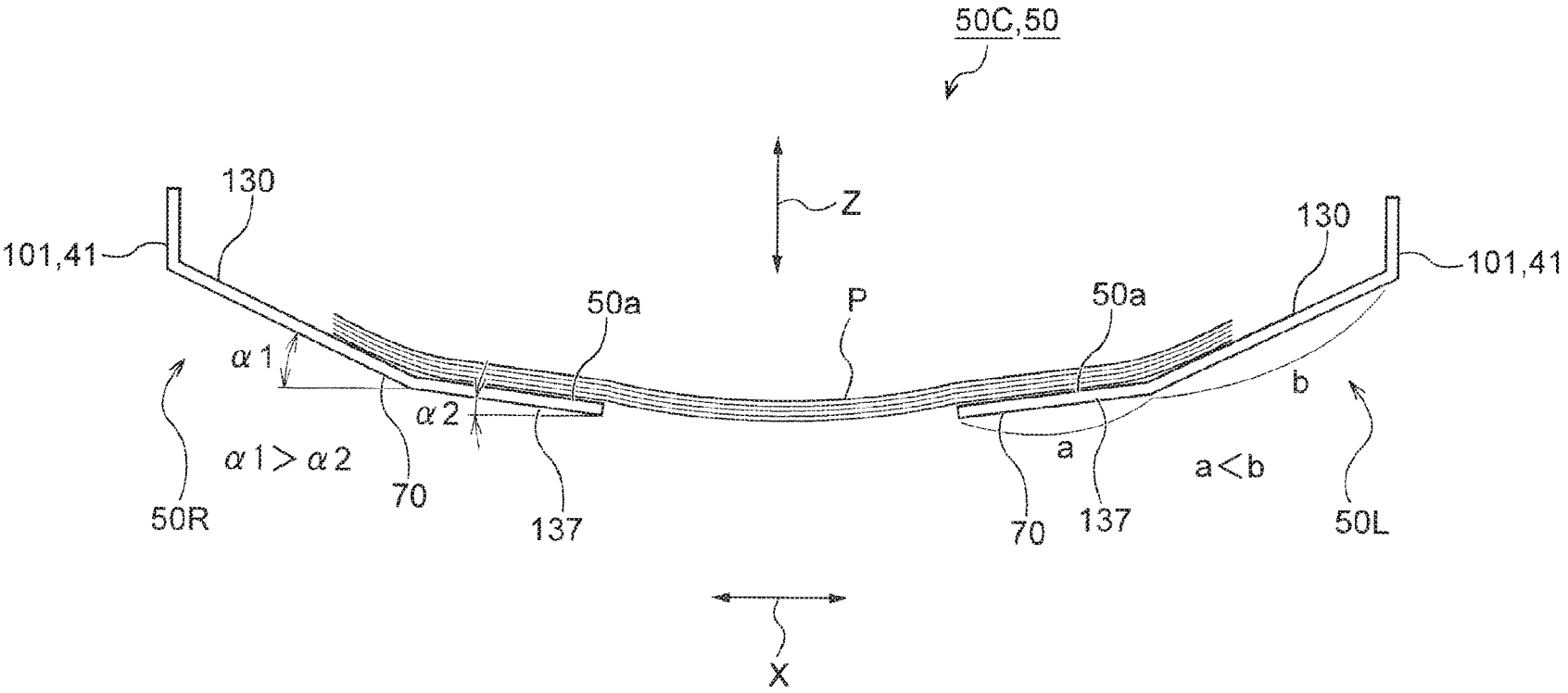
FIG. 23 is a front view showing another example of the shape of the medium supporting portion of the processing device of the present embodiment.

Further, as shown in FIG. 23, it is possible to provide the inclined portion 130 at an outer position of the support surface 50*a* of the medium supporting portion 50, which is separated from the center in the width direction X, and a gently inclined portion 137 having a smaller inclination angle α with respect to the horizontal than the inclined portion 130 at the inner position closer to the center in the width direction X than the inclined portion 130.

FIG. 23 shows a medium supporting portion 50C according to the modification example in which the support surface 50*a* of the lower support portion 70 in the medium supporting portion 50 is divided into two areas in the width direction X, in which the inclined portion 130 having an inclination angle α1 is disposed on the outer side coupled to the side plate 101 and the gently inclined portion 137 having an inclination angle α2 smaller than the inclination angle α1 is disposed on the inner side.

Also in this modification example, it is desirable that the left and right medium supporting portions 50L and 50R have symmetrical shapes so that the medium P can surely drop downward in the vertical direction Z when the support of the medium P is released.

Figure 24:
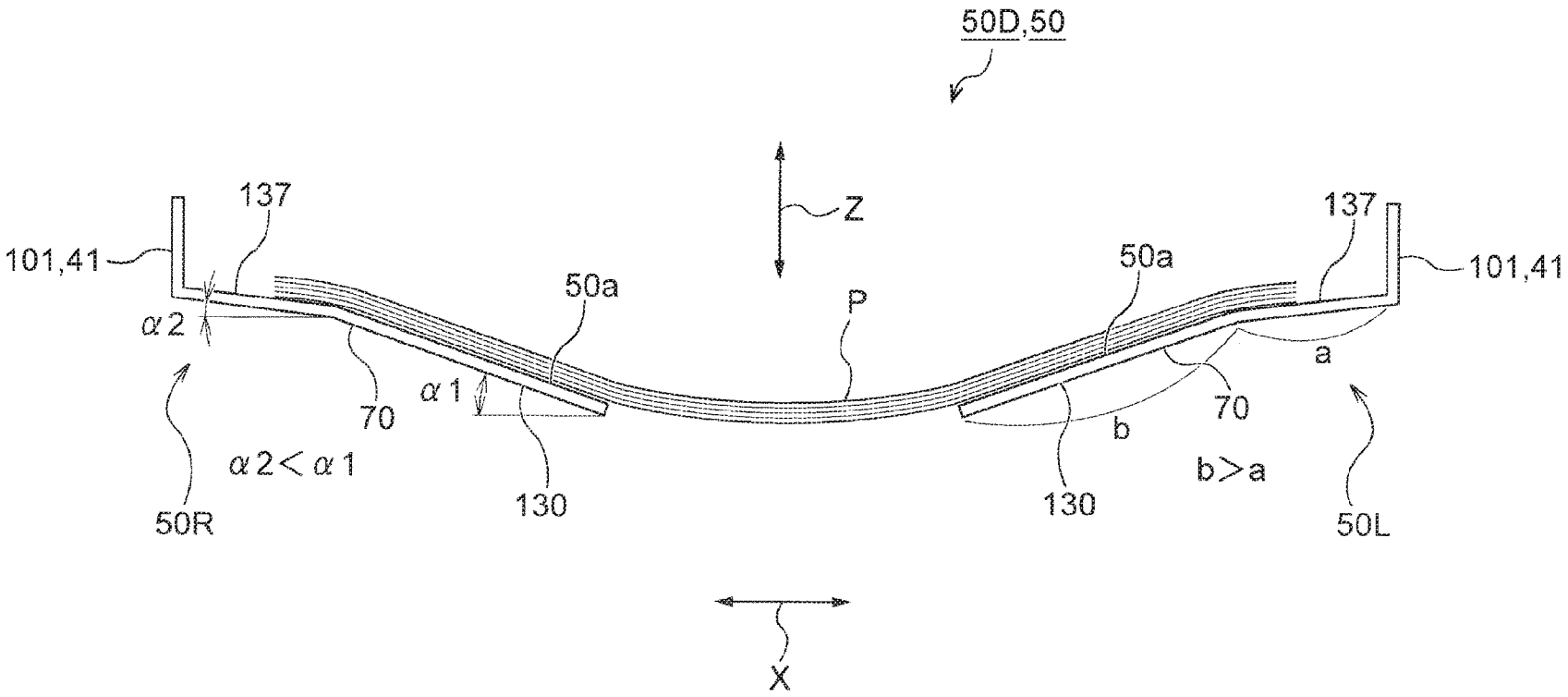
FIG. 24 is a front view showing another example of the shape of the medium supporting portion of the processing device of the present embodiment.

Further, as shown in FIG. 24, contrary to the modification example of FIG. 23, it is possible to provide the inclined portion 130 at the inner position near the center of the support surface 50*a* of the medium supporting portion 50 in the width direction X, and the gently inclined portion 137 having a smaller inclination angle α with respect to the horizontal than the inclined portion 130 at the outer position farther from the center in the width direction X than the inclined portion 130.

FIG. 24 shows a medium supporting portion 50D according to the modification example in which the support surface 50*a* of the lower support portion 70 in the medium supporting portion 50 is divided into two areas in the width direction X, in which the gently inclined portion 137 having a small inclination angle α2 is disposed on the outer side coupled to the side plate 101 and the inclined portion 130 having an inclination angle α1 larger than the inclination angle α2 is disposed on the inner side.

Also in the present modification example, it is desirable that the left and right medium supporting portions 50L and 50R are formed in a symmetrical shape so that the medium P can surely drop downward in the vertical direction Z when the support of the medium P is released.

In addition, in the medium supporting portions 50C and 50D according to the modification examples shown in FIGS. 23 and 24, an area b in which the inclined portion 130 is provided is formed wider than an area a in which the gently inclined portion 137 is provided. In FIGS. 23 and 24, the relationship between the area a in which the gently inclined portion 137 is provided and the area b in which the inclined portion 130 is provided is b>a.

Even in such a configuration, it is desirable that the left and right medium supporting portions 50L and 50R are formed in a symmetrical shape so that the medium P can surely drop downward in the vertical direction Z when the support of the medium P is released.

Configuration of Stacking Portion

The configuration of the stacking portion 37 is as already described. Therefore, as described above, the stacking portion 37 includes a paper discharge tray 71 that can be moved up and down to receive a bundle of the media P that the support by the medium supporting portion 50 is released and dropped downward in the vertical direction Z.

Then, when a bundle of media P is dropped onto the stacking surface 37*a* of the paper discharge tray 71, the sensor 79 detects the presence of the medium P, and the paper discharge tray 71 moves downward in the vertical direction Z by the stacking height of the bundle of dropped media P.

Discharge Operation Flow of Paper Discharge Device

The discharge operation flow of the medium P by the paper discharge device 30 of the present embodiment configured as described above is as follows.

1. Medium Alignment and Processing (See FIG. 7)

The medium P transported to the medium supporting portion 50 moves toward the upstream −Ya in the transport direction Ya along the inclination of the support surface 50*a* of the medium supporting portion 50 and the mounting surface 35*a* of the medium mounting portion 35, and the medium P is arranged by the rear end 59 of the medium P coming into contact with the bottom surface of the rear end aligning portion 38, and thereby the rear end 59 of the medium P is aligned. Further, the processing portion 36 performs the above-described predetermined processing on the medium P to which the aligning is performed.

2. Discharge of Medium (see FIG. 8)

The bundle of the media P on which the media P is aligned and processed is discharged toward the downstream +Ya in the paper discharge direction Ya by the sandwiching and feeding action of the medium transport portion 34 and the medium mounting portion 35. As shown in FIG. 8, the entire portion of the medium P including the front end portion 53 and the rear end 59 side portion is discharged from the mounting surface 35*a* of the medium mounting portion 35 and moved onto the support surface 50*a* of the medium supporting portion 50.

3. Medium Support (see FIG. 16)

Figure 16:
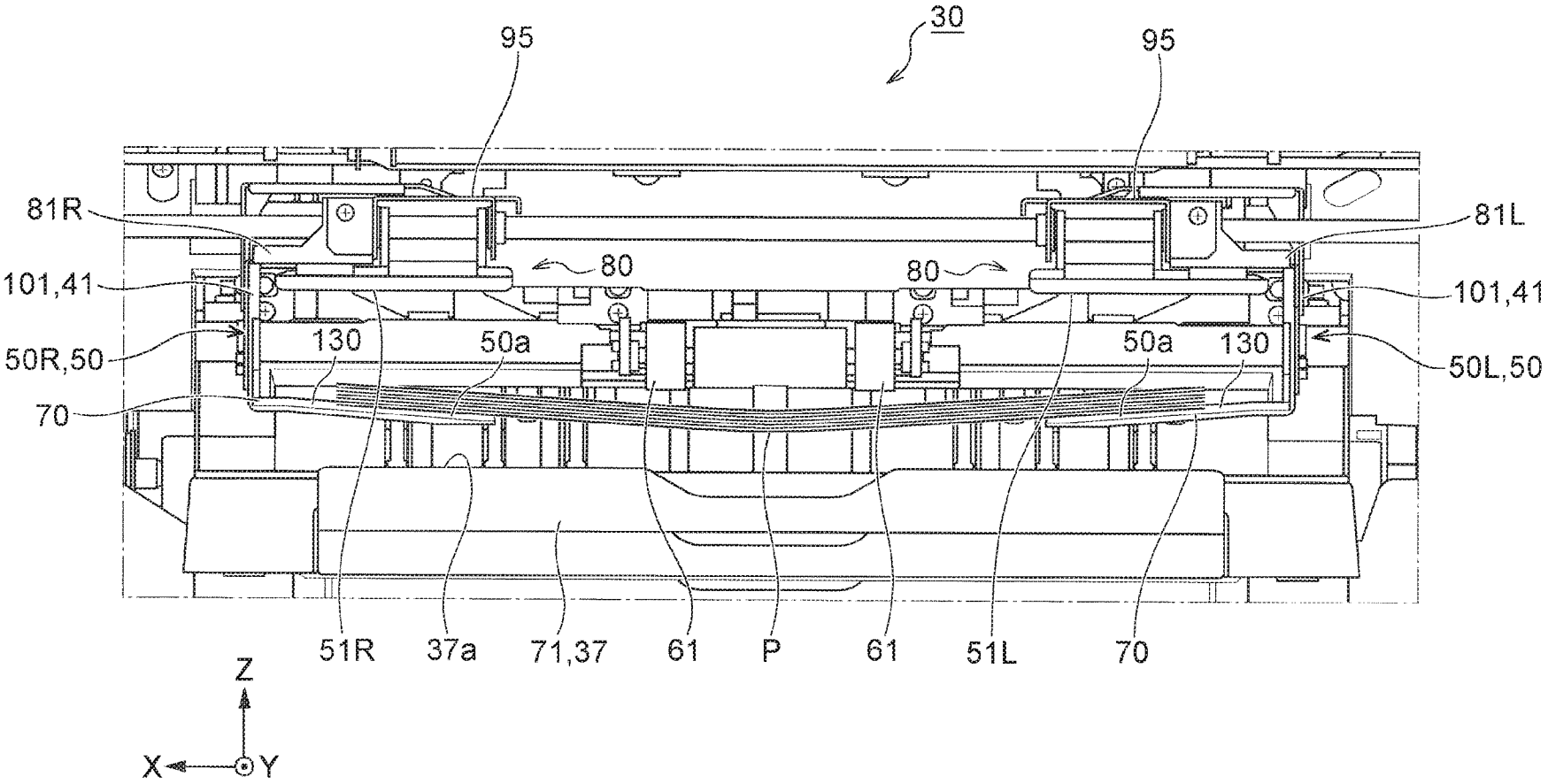
FIG. 16 is a view showing a paper discharge device of the processing device of the present embodiment as viewed from a direction of arrow XVI, XVII, XVIII in FIG. 8.
Figure 17:
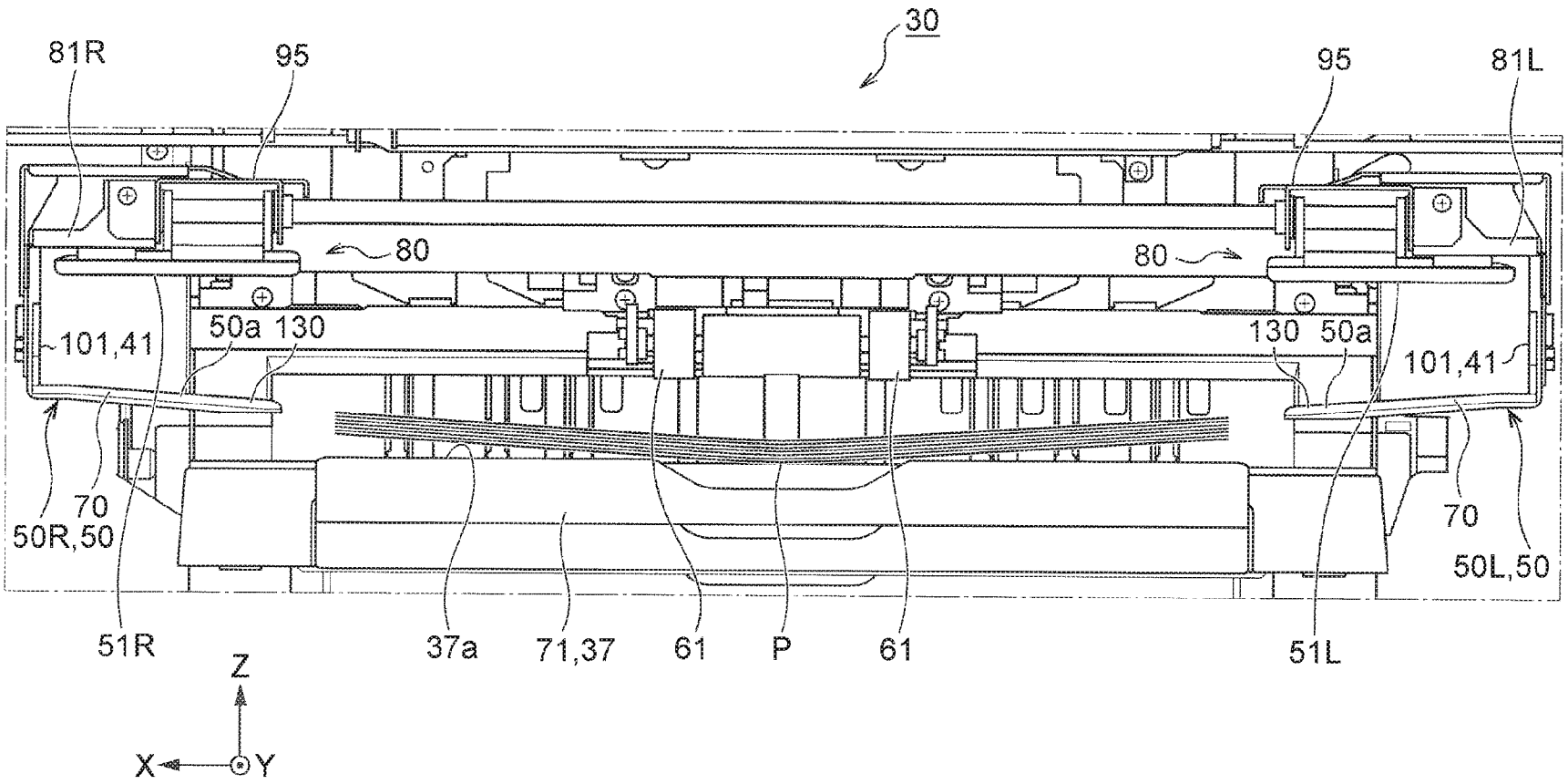
FIG. 17 is a view showing the paper discharge device of the processing device of the present embodiment as viewed from the direction of arrow XVI, XVII, XVIII in FIG. 8 when a medium is dropped.
Figure 18:
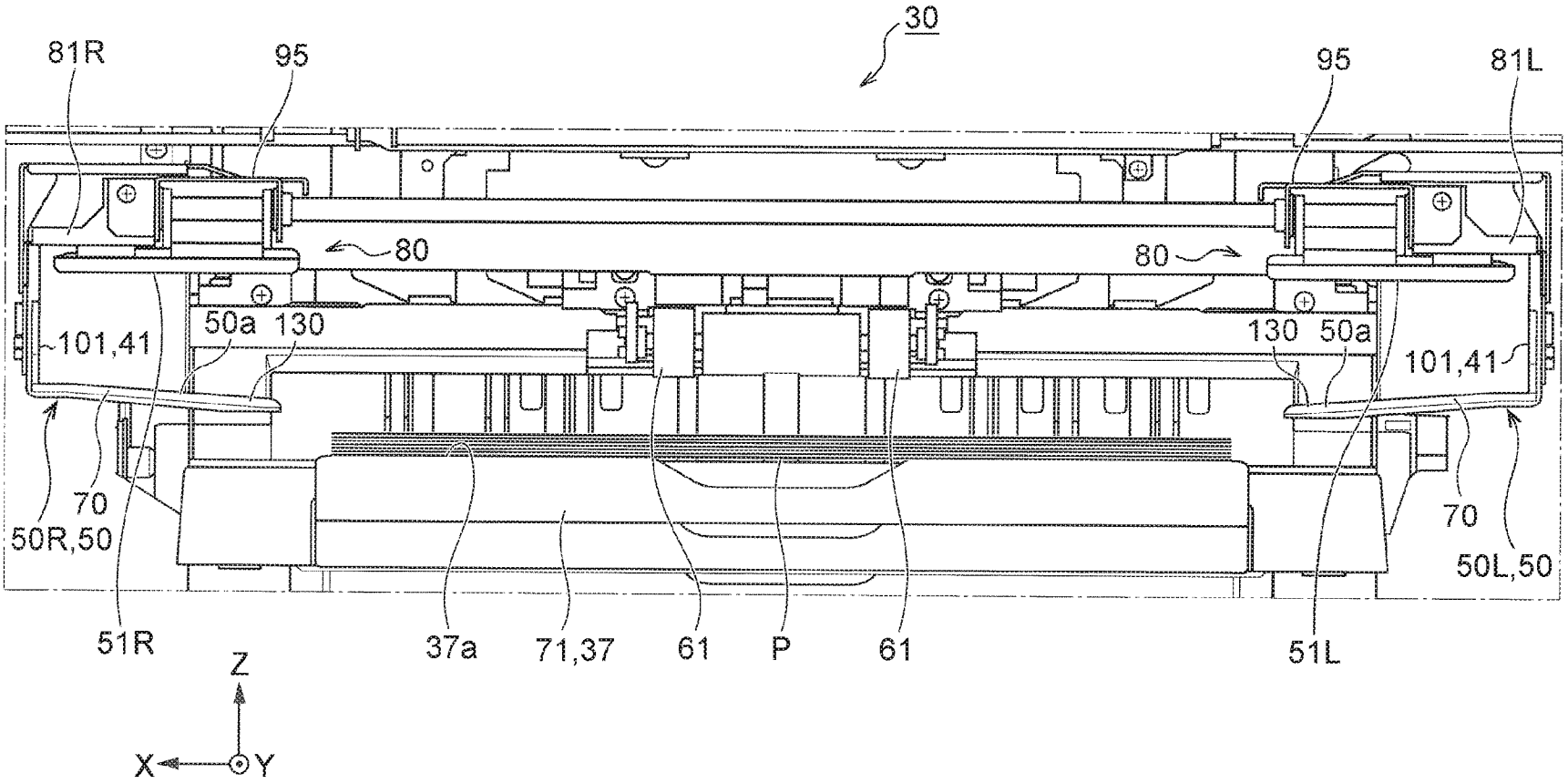
FIG. 18 is a view showing the paper discharge device of the processing device of the present embodiment when a medium is stacked as viewed from the direction of arrow XVI, XVII, XVIII in FIG. 8.

In this state, as shown in FIG. 16, the bottom surfaces of the bundle of media P near the side ends 57L and 57R are supported by the support surfaces 50*a* and 50*a* of the lower support portions 70 and 70 of the pair of left and right medium supporting portions 50L, 50R disposed facing each other in the medium width direction X. In the present embodiment, the bundle of media P has a flat U-shape with center hanging down slightly by the inclined portion 130 provided on the support surface 50*a*.

4. Release of Support of Medium (see FIG. 17)

Next, in order to release the support of the medium P, the left and right medium supporting portions 50L and 50R respectively move outward and become in the open state.

At this time, in the present embodiment, the friction force acting on the contact surface between the support surface 50*a* and the lower surface of the medium P is reduced by the inclined portion 130 provided on the support surface 50*a* of the lower support portion 70 of the medium supporting portion 50. Therefore, the bundle of medium P remains substantially at that position, and only the left and right medium supporting portions 50L and 50R move outward in the medium width direction X.

5. Drop of Medium (see FIG. 17)

When the support by the medium supporting portion 50 is released, the medium P supported by the medium supporting portion 50 drops from the central portion that hangs downward to the stacking surface 37*a* of the paper discharge tray 71 of the stacking portion 37.

Also in this case, the medium P drops downward in the vertical direction Z by the action of the inclined portion 130 provided on the lower support portion 70 of the medium supporting portion 50 without causing positional displacement.

6. Stacking Medium (see FIG. 18)

Since the bundle of media P dropped from the medium supporting portion 50 drops downward in the vertical direction Z without causing positional displacement, the bundle of media P is stacked on the stacking surface 37*a* of the paper discharge tray 71 of the stacking portion 37 which is standing by at the lowermost position below while keeping the same position.

When a bundle of media P is stacked on the stacking surface 37*a* of the paper discharge tray 71, the sensor 79 checks the stacking of the media P, and the paper discharge tray 71 moves down by the stacking height of the media P and prepare for the next stack of bundle of media P. Thereafter, the same operation is repeated to sequentially stack the bundle of media P on the stacking surface 37*a* of the paper discharge tray 71.

Explanation of Effect of Paper Discharge Device

The paper discharge device 30 according to the present embodiment has the above-described configuration, and thus the following effects can be obtained.

1. First, in the present embodiment, the inclined portion 130 that is inclined downward toward the center in the medium width direction X is provided on at least a portion of the support surface 50*a* with respect to the pair of medium supporting portions 50L and 50R.

According to the present embodiment, it is possible to reduce the influence of friction on the contact surface between the support surface 50*a* of the medium supporting portion 50 and the lower surface of the medium P by the inclined portion 130. The shift of the drop position in the width direction X due to the "drag" of the medium P due to the imbalance of the friction force between the left and right medium supporting portions is suppressed in the medium supporting portion of the related art.

Further, according to the present embodiment, the distance between the support surface 50*a* and the stacking surface 37*a* is shortened by the inclination of the inclined portion 130 due to the existence of the inclined portion 130. It is possible to reduce the risk of the drop position being displaced due to air resistance during the drop of the medium P. In particular, this effect is prominent when the bundle of mediums P is a lightweight bundle composed of a small number of sheets.

2. Further, when the inclined portion 130 is provided on at least a part of the support surface 50*a* in the transport direction Ya, it is possible to reduce the risk that the drop position of the medium P being displaced in the medium width direction X due to the reduction of the friction force due to the provision of the inclined portion 130 when the pair of medium supporting portions 50L and 50R are moved outward in the medium width direction X and the medium P is moved and dropped.

When a part of the support surface 50*a* is the inclined portion 130 and the remaining part of the support surface 50*a* is the flat portion 131, since the supporting force when the medium P is supported by the medium supporting portion 50 increases due to the presence of the flat portion 131, the medium P can be stably supported.

3. When the inclined portion 130 is provided on at least a part of the support surface 50*a* in the medium width direction X, similar to when the inclined portion 130 is provided on at least a part of in the transport direction Ya, it is possible to reduce the risk that the drop position of the medium P being displaced in the medium width direction X due to the reduction of the friction force due to the provision of the inclined portion 130 when the pair of medium supporting portions 50L and 50R are moved outward in the medium width direction X and the medium P is moved and dropped.

4. Further, when the inclined portion 130 is provided on the entire area of the support surface 50*a*, the inclined portion 130 can reduce the influence of the friction force over the entire area of the support surface 50*a*.

As a result, when the pair of medium supporting portions 50L and 50R are moved outward in the medium width direction X to drop the medium P, the friction force is greatly reduced due to the provision of the inclined portion 130 in the entire area, so that it is possible to further reduce the risk that the drop position of the medium P is displaced in the medium width direction X.

5. Further, when the inclined portion 130 at an outer position of the support surface 50*a*, which is separated from the center in the width direction X, and a gently inclined portion 137 having a smaller inclination angle $\alpha$ with respect to the horizontal than the inclined portion 130 at the inner position closer to the center in the width direction X than the inclined portion 130 are provided, the presence of the gently inclined portion 137 stabilizes the medium supporting state when the pair of medium supporting portions 50L and 50R supports the medium P.

On the other hand, when the pair of medium supporting portions 50L and 50R are separated from each other to release the support of the medium P, by reducing the friction force due to the provision of the inclined portion 130, it is possible to reduce the risk of the drop position of the medium P being displaced in the medium width direction X.

Further, by aligning the shapes of the inclined portion 130 and the gently inclined portion 137 on the support surfaces 50*a* of the left and right medium supporting portions 50L and 50R, the medium P is guided so as to have a U-shape, and the distance to the stacking surface 37*a* of the medium P is shorted. As a result, it is possible to reduce the risk that the drop position of the medium P is being displaced due to the influence of air resistance during the drop.

6. Further, contrary to 5. described above, when the inclined portion 130 is provided at an inner position near the center of the support surface 50*a* in the width direction X and the gently inclined portion 137 having a smaller inclination angle α with respect to the horizontal than the inclined portion 130 is provided at the outer position separated from the center in the width direction XC than the inclined portion 130 are provided, similar to 5. above, the presence of the gently inclined portion 137 stabilizes the medium supporting state when the pair of medium supporting portions 50L and 50R supports the medium P.

Further, it becomes possible to support the medium P by moving the pair of medium supporting portions 50L and 50R to appropriate positions that match the properties of the medium P. When releasing the support state and dropping the medium P, similar to 5. above, it is possible to reduce the risk of the drop position being displaced due to air resistance during the drop of the medium P.

7. Further, in 5. and 6. described above, the area b in which the inclined portion 130 is provided and the area a in which the gently inclined portion 137 is provided are provided by dividing the support surface 50*a* into two in the medium width direction X. It is possible to set the area b in which the inclined portion 130 is provided to be wider than the area a in which the gently inclined portion 137 is provided.

As a result, the friction force between the lower surface of the medium P and the support surface 50*a* is reduced, and the risk of the drop position being displaced in the medium width direction X when the medium P is dropped onto the stacking surface 37*a* of the paper discharge tray 71 can be further reduced.

Explanation of Effect of Processing Device

The processing device 4 of the present embodiment has the above-described configuration, and thus the following effects can be obtained.

1. First, the pressing surface 51*a* of the pressing portion 51 is movable between the first position Q1 in the retracted state and the second position Q2 for pressing the medium P that is a position closer to the support surface 50*a* than the first position Q1. The pressing portion 51 is disposed at the first position Q1 retracted when the medium P is transported to the medium supporting portion 50. By setting the first position Q1 appropriately by grasping the degree of the curl in advance, even when the medium P being transported has a curl, the curl does not come into contact with the pressing portion 51. As a result, the medium P can be smoothly transported and received on the medium supporting portion 50.

On the other hand, after the rear end aligning portion 38 aligns at least the front end portion 53 of the medium P supported by the medium supporting portion 50, the pressing portion 51 moves to the second position Q2, and the medium P is pressed. As a result, when the medium P is curled, for the medium having a curl that is large enough to come into contact with the pressing surface 51*a* at the second position Q2, the curl can be reduced or almost eliminated by the pressing portion 51 pressing the medium P at the second position Q2. Further, when there is a curl in the process of growing, it is possible to suppress the growth of the curl by pressing with the pressing portion 51. As described above, the smooth transport of the medium P to the medium supporting portion 50 and the smooth stacking of the medium P to the stacking portion 37 can be performed without being hindered.

2. Further, according to the present embodiment, the second distance L2 corresponding to the height of the state in which the medium P is pressed is shorter than the first distance L1 corresponding to the height of the stacking area of the stacking portion 37. That is, the pressing portion 51 presses the medium P on the support surface 50*a* so as to be shorter than the first distance L1 which is the distance between the stacking surface 37*a* and the medium supporting portion 50. As a result, the height H of the medium P pressed by the pressing portion 51 and dropped onto the stacking portion 37 becomes equal to or less than the first distance L1, and thus it is possible to reduce the risk of the medium P coming into contact with the medium supporting portion 50.

3. According to the present embodiment, the stacking portion 37 drops the bundle of the media P from the medium supporting portion 50 and then moves down the distance D corresponding to the height H of the dropped bundle of the media P in the stacking direction. As a result, the height of the stacking area of the stacking portion 37 does not change even when a bundle of media P is stacked on the stacking portion 37 and the stacking amount increases, and can be maintained at a substantially constant height.

Figure 12:
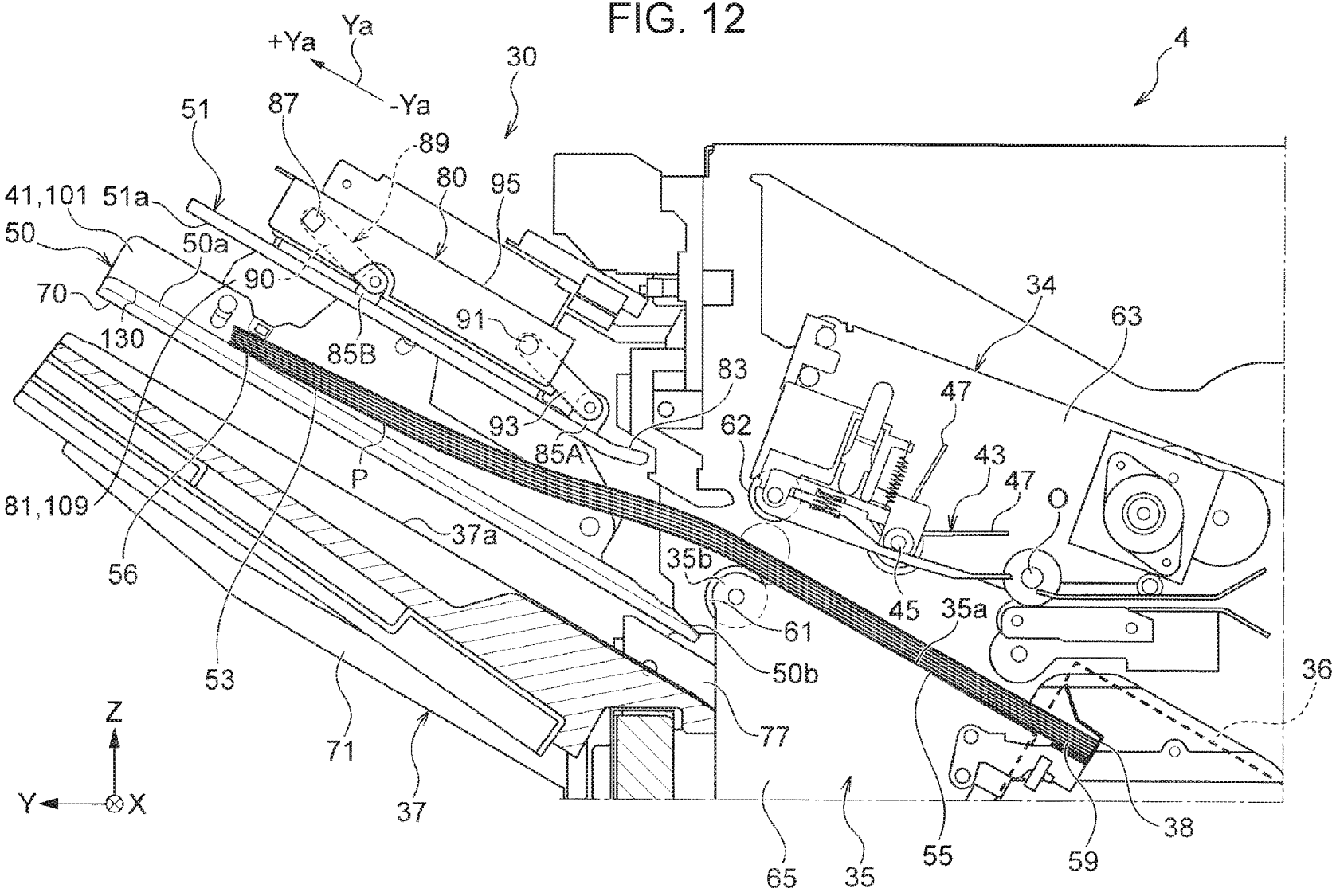
FIG. 12 is a side sectional view showing the processing device according to the present embodiment at the time of primary receiving of a medium when a medium having a high stiffness is used.
Figure 13:
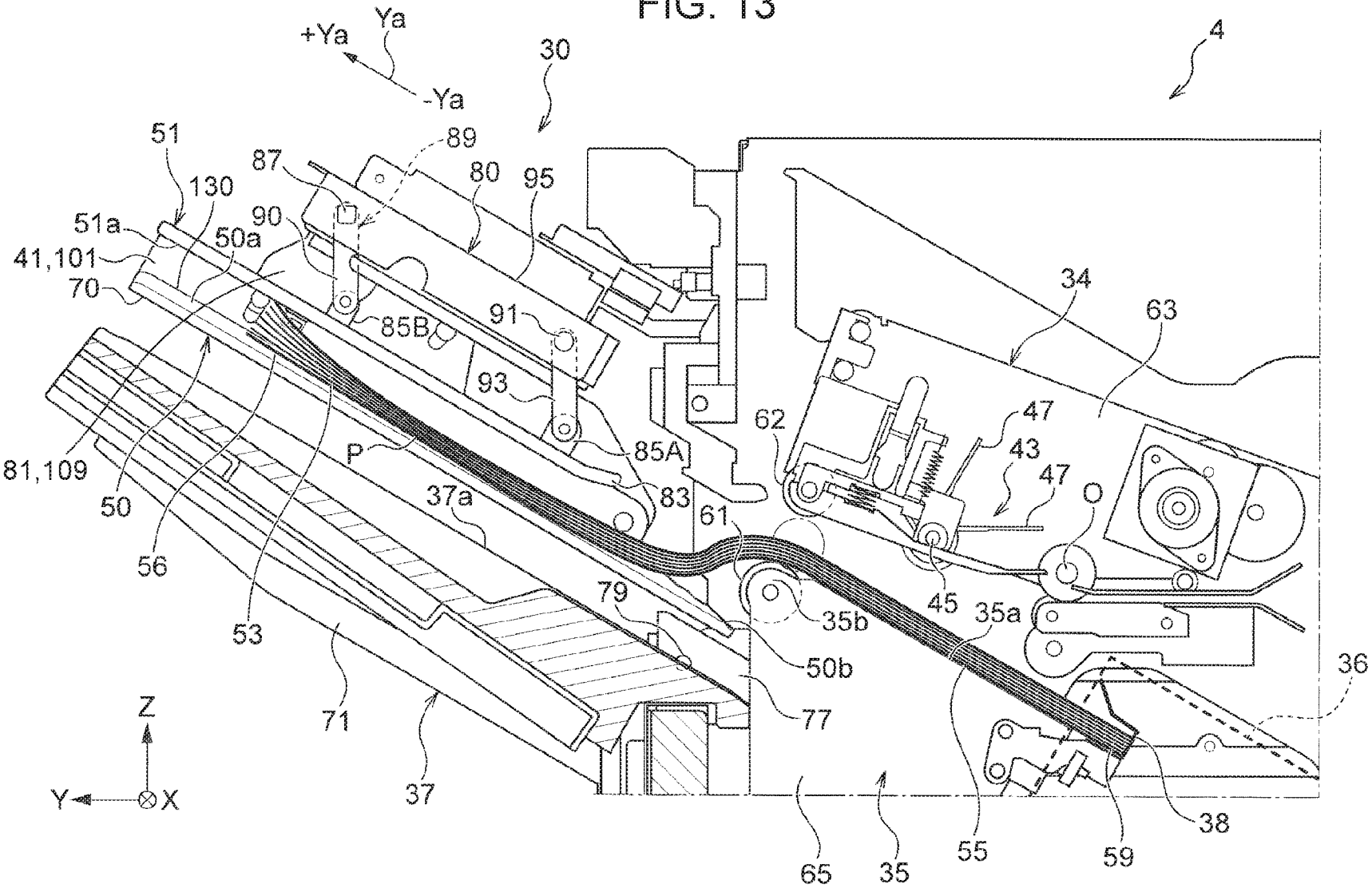
FIG. 13 is a side sectional view showing the processing device according to the present embodiment when a medium is pressed when a medium having a high stiffness is used.

4. Further, according to the present embodiment, the medium mounting portion 35 is disposed such that the height position of the rear end 50*b* of the support surface 50*a* in the transport direction Ya is lower than the height position of the front end 35*b* of the mounting surface 35*a* in the transport direction Ya, and the distance is longer than the second distance L2. Accordingly, the pressing portion 51 presses the bundle of media P supported across the medium supporting portion 50 and the medium mounting portion 35. Even when the medium P having high stiffness and high rigidity that cannot form a Z-shaped curved shape under no load is used as shown in FIG. 12, the side shape of the medium P can be easily deformed into an S-shaped or Z-shaped non-linear shape as shown in FIG. 13.

By this deformation, it is possible to reduce the friction force between the media P and improve the aligning property by the rear end aligning portion 38.

When the medium P has a weak stiffness, the stiffness of the medium P is strengthened by deforming the medium P into the non-linear shape, and a shift operation of the medium P in the medium width direction X intersecting the transport direction Ya can be performed with good stability.

5. Further, according to the present embodiment, the processing portion 36 can perform a predetermined process such as a stapling process or the like on the bundle of the media P with the rear end 59 having aligning property at a position on the left or right near the rear end 59 or in the central portion.

Contents of Control Method of Processing Device

A control method of a processing device according to the present disclosure is a control method in which the main operations are transport, aligning, and pressing of the medium P of the processing device 4 including the above-described components, the method includes a first step P1, which is a transport preparation step of the medium P, a second step P2, which a transport performance step, a third step P3, which is an alignment step, and a fourth step P4 which is a pressing step.

Further, in the present embodiment, a fifth step P5, which is a processing step performed after the alignment of all the media P to be bundled is completed, a sixth step P6, which is a paper discharging step performed after the processing, and a seventh step P7, which is a stacking step performed after paper discharging. These controls are performed by the control portion 15 described above. Hereinafter, the contents of these steps will be specifically described in order.

Figure 14:
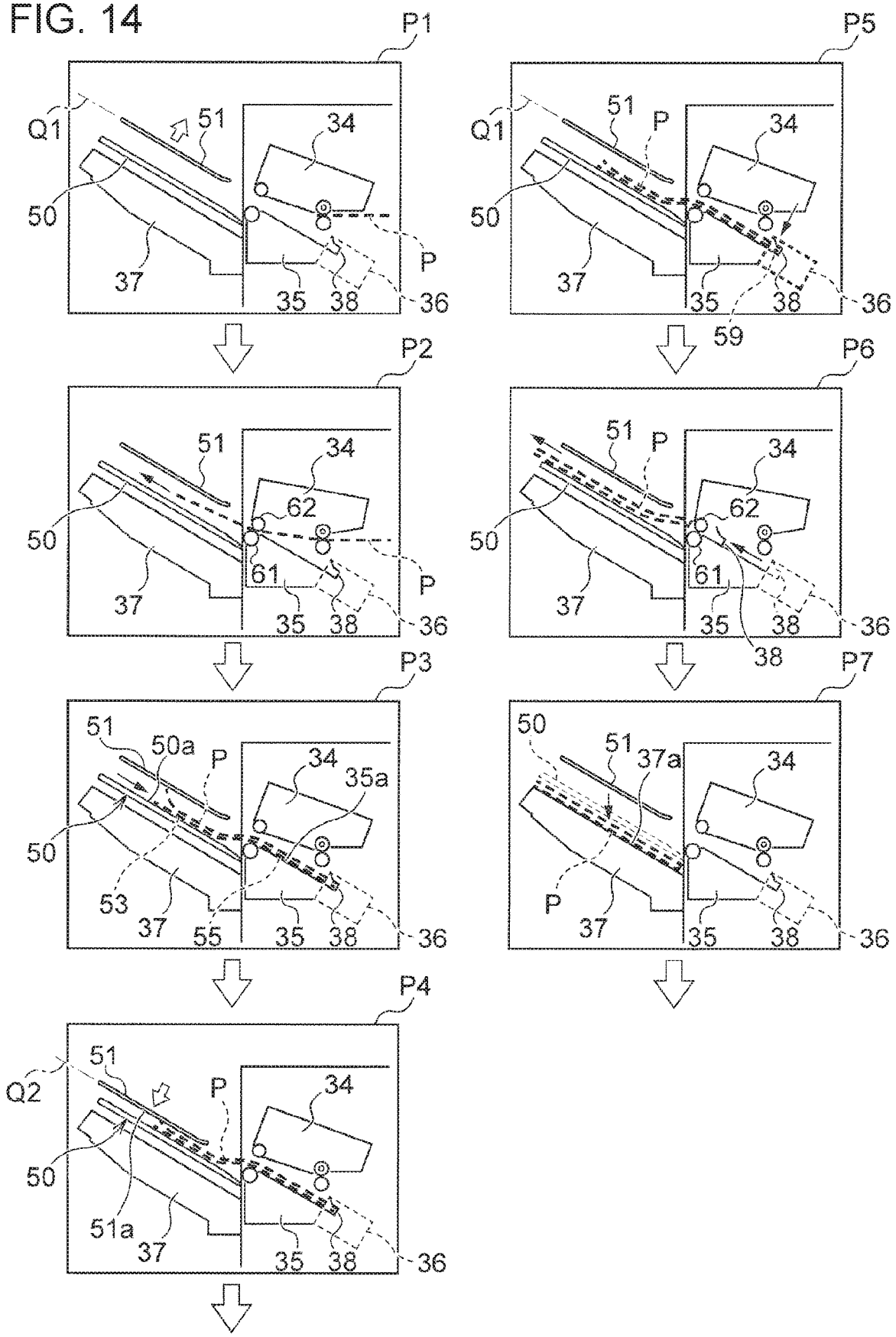
FIG. 14 is a process diagram showing a control method of the processing device of the present embodiment.

First Step (see FIGS. 3 and 14)

The first step P1 is a transport preparation step performed prior to receiving the medium P and is a step of disposing the pressing portion 51 at the first position Q1.

That is, a motor (not shown) is driven to drive the pressing mechanism 80 to move the pressing portion 51 to the first position Q1 which is the upper retracted position. In this state, a large space for receiving the medium P is secured between the medium supporting portion 50 and the pressing portion 51.

Figure 4:
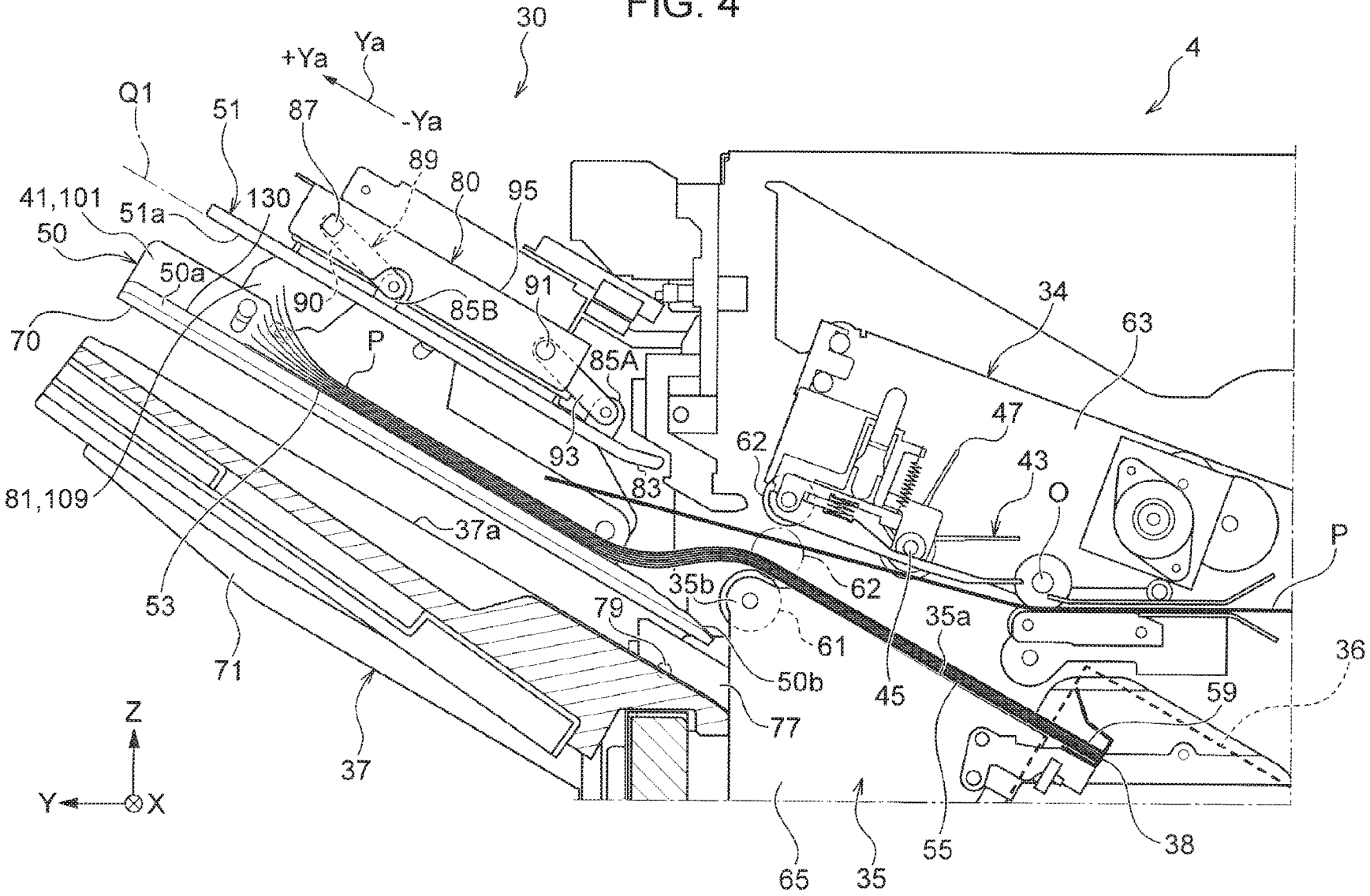
FIG. 4 is a side sectional view showing the processing device of the present embodiment at the time of primary receiving of a medium.

Second Step (see FIGS. 4 and 14)

The second step P2 is a step of actually transporting the medium P toward the medium supporting portion 50 after the preparation for transport is completed by the first step P1.

That is, by driving a motor and power transmission section (not shown) to apply a downstream +Ya transport force in the transport direction Ya, the front end portion 53 of the medium P is sequentially advanced into the space between the pressing portion 51 and the medium supporting portion 50 as shown in FIG. 4.

When the medium P is transported to a predetermined position, the medium P slides and moves upstream −Ya in the transport direction Ya due to the inclination of the support surface 50*a* and the mounting surface 35*a* and stops at the position where the rear end 59 of the medium P comes into contact with the bottom surface of the rear end aligning portion 38 as shown in FIG. 4.

In this state, when the medium P having a weak stiffness is used, the medium P is curved midway due to the step between the support surface 50*a* and the mounting surface 35*a* and is stocked in a curved non-linear shape of S-shape or Z-shape as shown in FIG. 4.

Third Step (see FIGS. 4 and 14)

The third step P3 is an alignment step in which the rear end aligning portion 38 aligns the medium P whose front end portion 53 is supported by the medium supporting portion 50 and whose rear end portion 55 is supported by the medium mounting portion 35.

That is, in addition to the movement of the medium P due to its own weight using the inclination of the support surface 50*a* and the mounting surface 35*a*, the paddle mechanism 43 is driven to rotate the paddle 47 in a predetermined direction, that is, in the direction of moving the medium P to the upstream-Ya, so that the rear ends 59 of all the media P to be bundled are brought into contact with the bottom surface of the rear end aligning portion 38.

In the present embodiment, by using the non-linear medium P described above, the friction force between the stacked media P is reduced, and the medium P can be smoothly moved in the alignment direction.

At the same time, the side ends of the medium P are aligned by shifting the second side end aligning portion 41 and the medium supporting portion 50 in the medium width direction X.

Fourth Step (see FIGS. 4 to 6, 12, and 13)

The fourth step P4 is a pressing step in which the pressing portion 51, which has been located at the first position Q1 that is the retracted position, is moved to the medium supporting portion 50 side and is located at the second position Q2 that is the pressing position to press the medium P.

That is, a motor and a power transmission section (not shown) are driven to pivot the drive shaft 87 in a predetermined direction to operate the pressing mechanism 80. As a result, the pressing portion 51 moves so as to swing to the downstream +Ya in the transport direction Ya, approaches the medium supporting portion 50 side, and reaches the second position Q2 shown in FIG. 5.

Figure 5:
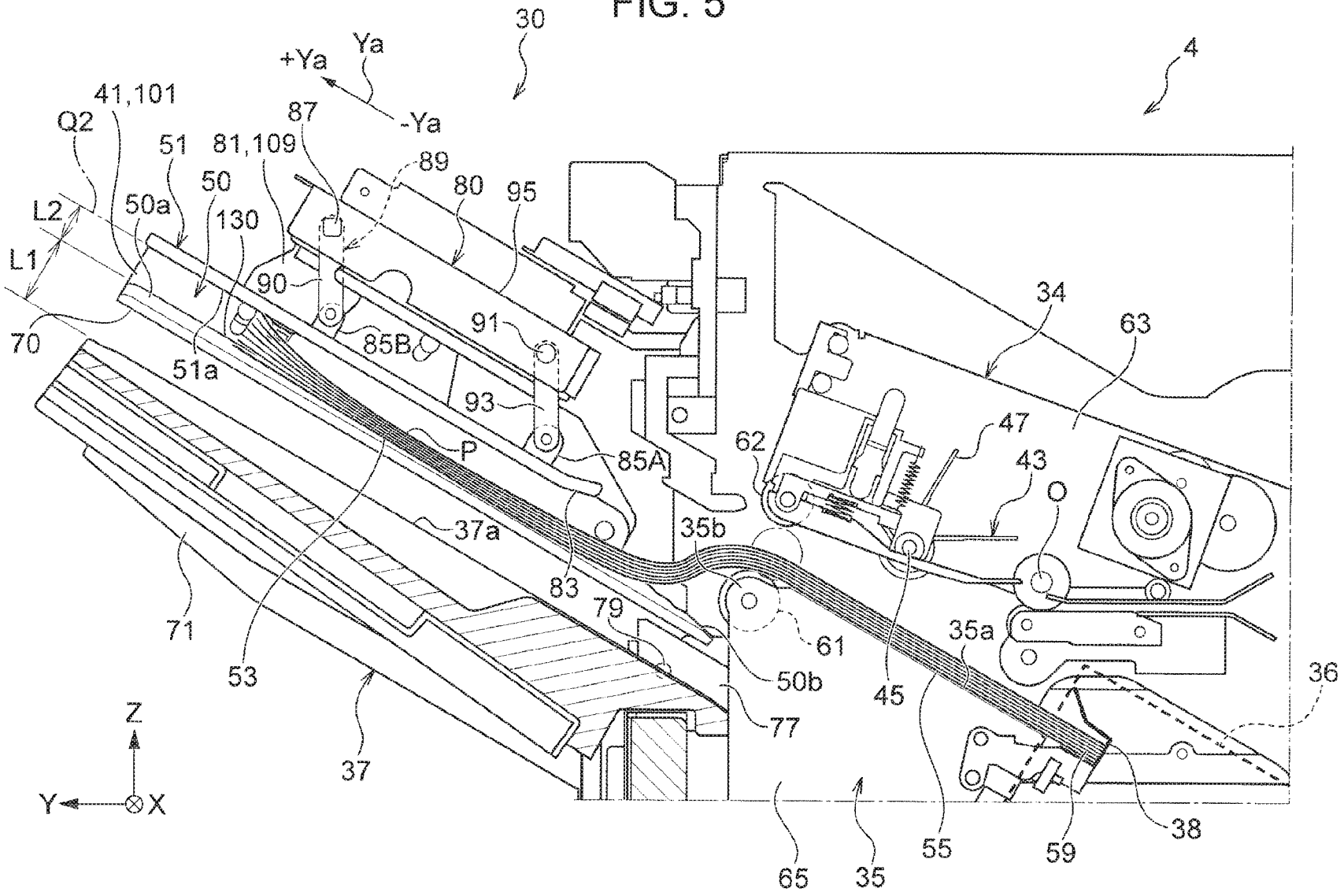
FIG. 5 is a side sectional view of the processing device according to the present embodiment when a medium is pressed.

When the pressing portion 51 reaches the second position Q2, as shown in FIG. 5, the pressing surface 51*a* of the pressing portion 51 acts on the curl generated at the front end 56 of the medium P and presses in the direction in which the curl becomes smaller.

Figure 6:
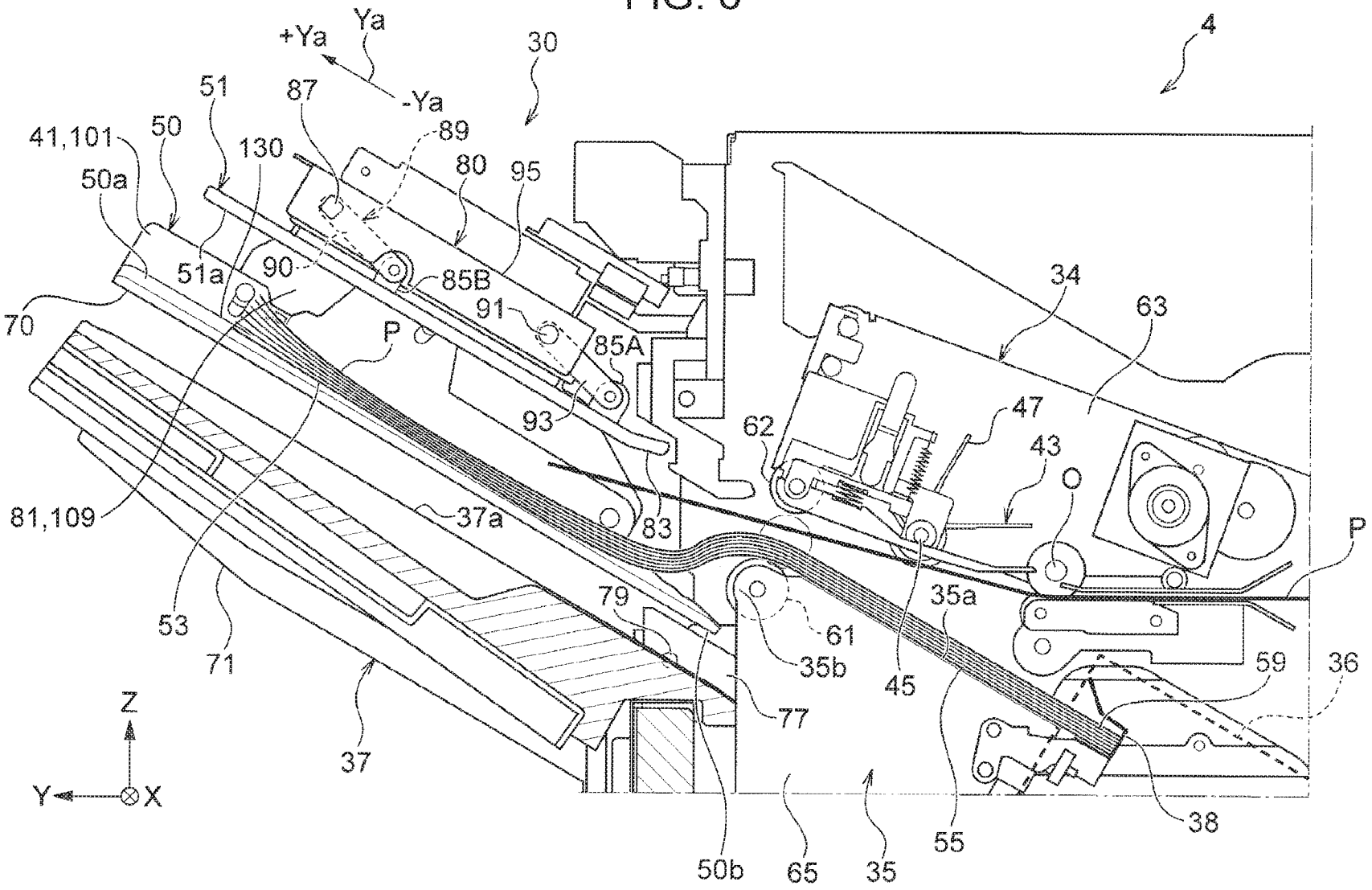
FIG. 6 is a side sectional view showing the processing device of the present embodiment at the time of secondary receiving of a medium.

Further, in preparation for receiving the next medium P, the pressing portion 51 again moves to the first position Q1 as shown in FIG. 6. Even in this state, the height of the curl generated at the front end 56 of the previously received medium P is maintained as shown in FIG. 6 which is lower than the height shown in FIG. 4 before pressing by the pressing portion 51.

Further, even when the medium P having high stiffness and high rigidity is used, as shown in the change in shape of the medium P shown in FIGS. 12 and 13, due to the pressing operation of the pressing portion 51 in this step, the medium P has an S-shaped or Z-shaped non-linear shape, so that the friction force between the stacked media P is reduced.

Figure 7:
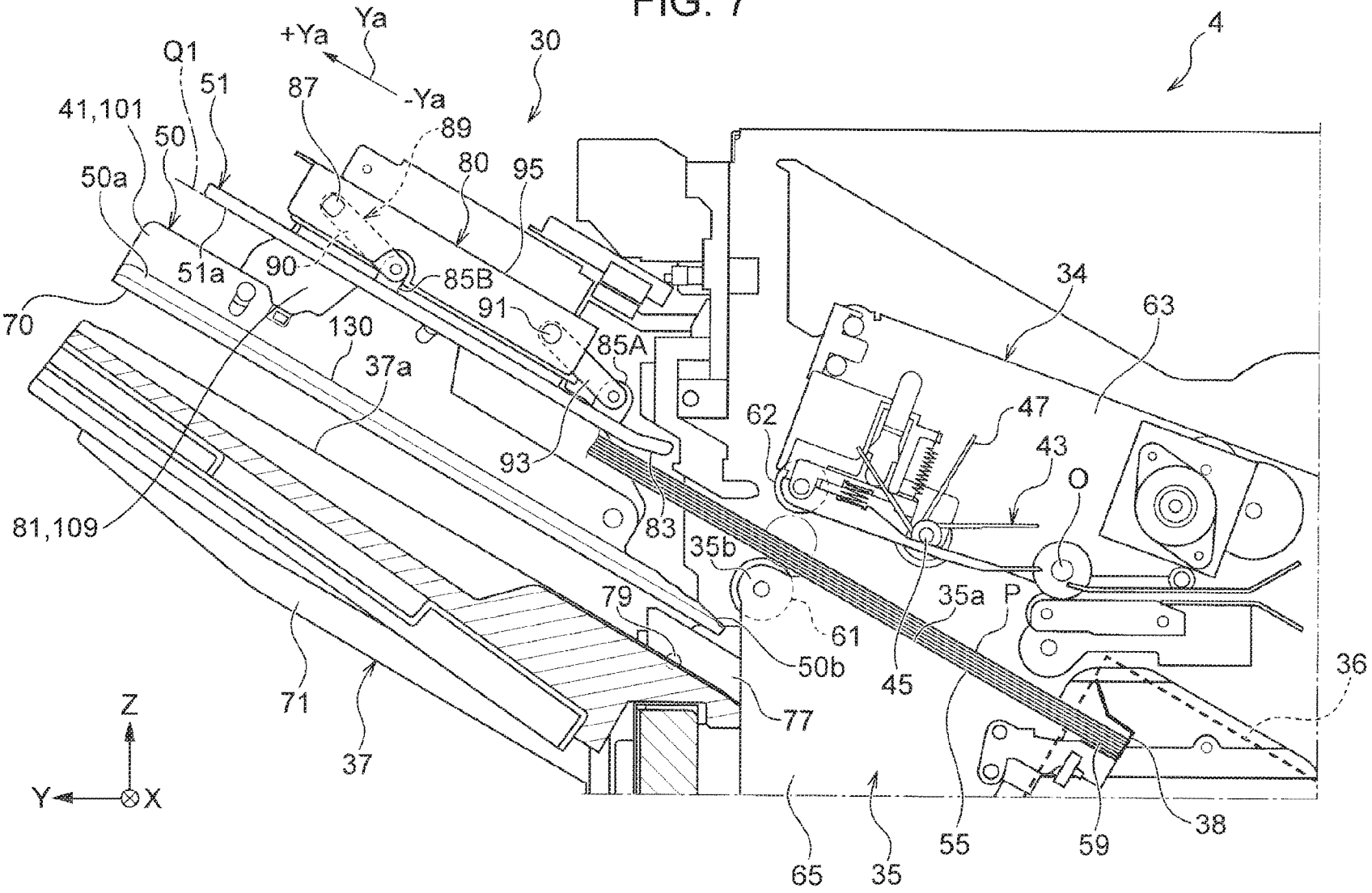
FIG. 7 is a side sectional view showing the processing device of the present embodiment after medium aligning and processing.

Fifth Step (See FIGS. 7 and 14)

The fifth step P5 is a processing step of performing a predetermined process on the bundle of media P for which alignment has been completed.

That is, a predetermined process such as a stapling process at the left and right corners or the central portion of the rear end 59 of the bundle of media P is performed by using the appropriate processing portion 36 disposed near the rear end aligning portion 38. In the present embodiment, the pressing portion 51 is retracted to the first position prior to the processing by the processing portion 36. However, depending on the type of the medium P, the pressing portion 51 may perform the processing of the processing portion 36 in the state of being held at the second position. In FIGS. 7, 8, 10, and 11, the front end portion 53 side of the medium P is not shown in order to avoid complication of the drawings.

Figure 9:
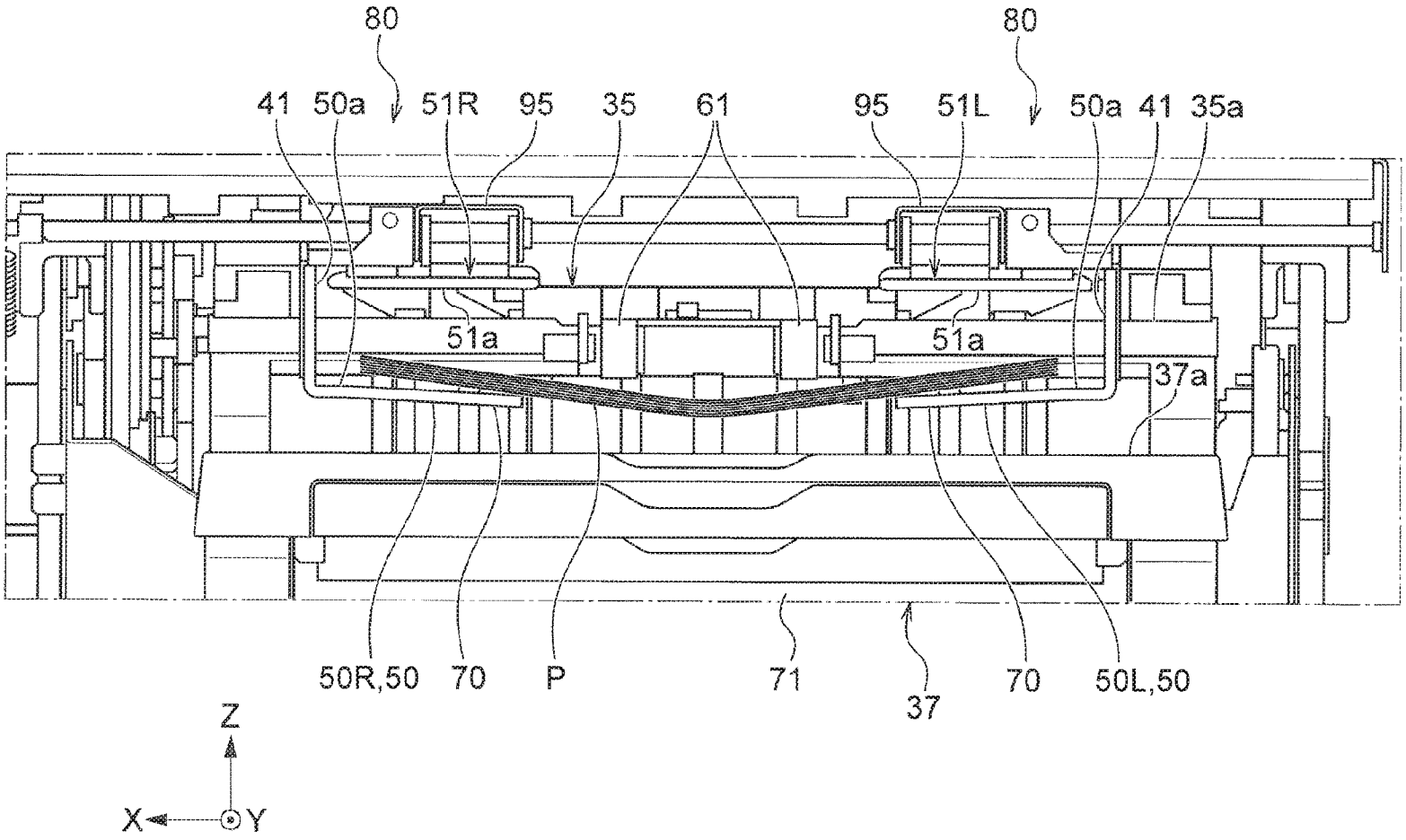
FIG. 9 is a view showing the processing device of the present embodiment as viewed from a direction of arrow IX in FIG. 8.

Sixth Step (see FIGS. 8, 9, and 14)

The sixth step P6 is a paper discharging step in which the bundle of the media P on which the predetermined processing has been performed is moved to the downstream +Ya position in the paper discharge direction Ya, and the entire end of the media P including the rear end portion 55 is moved to the medium supporting portion 50 side.

That is, the transport drive roller 61 is driven to bring the transport driven roller 62 into the nip state, and the medium P is discharged. At the same time, the rear end aligning portion 38 is moved to the downstream +Ya in the paper discharge direction Ya to push up the rear end 59 of the medium P to assist the discharge of the medium P. Incidentally, the structure may be such that the rear end aligning portion 38 is not moved to the downstream +Ya in the paper discharge direction Ya.

Figure 10:
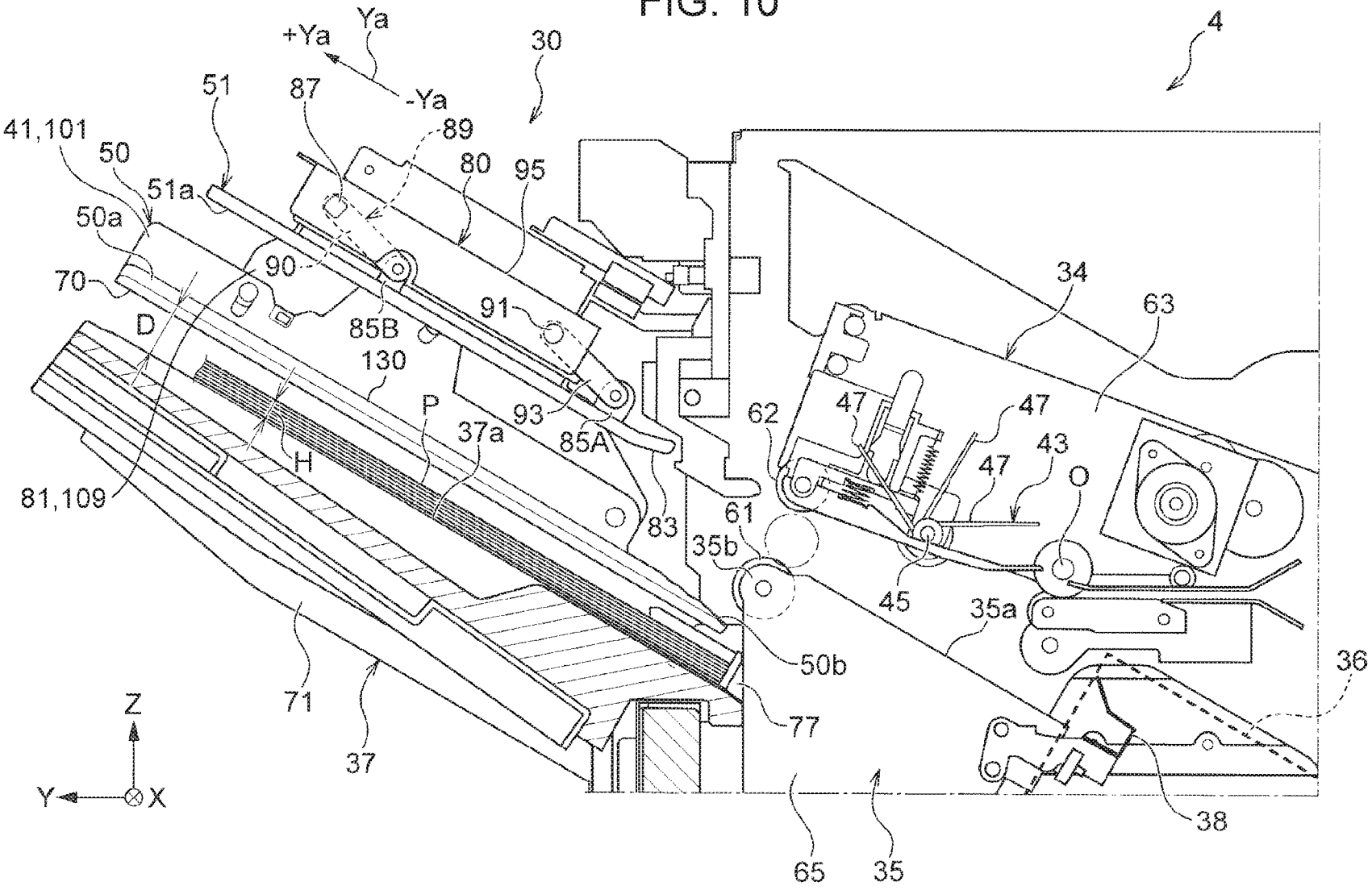
FIG. 10 is a side sectional view showing the processing device of the present embodiment when stacking a medium.
Figure 11:
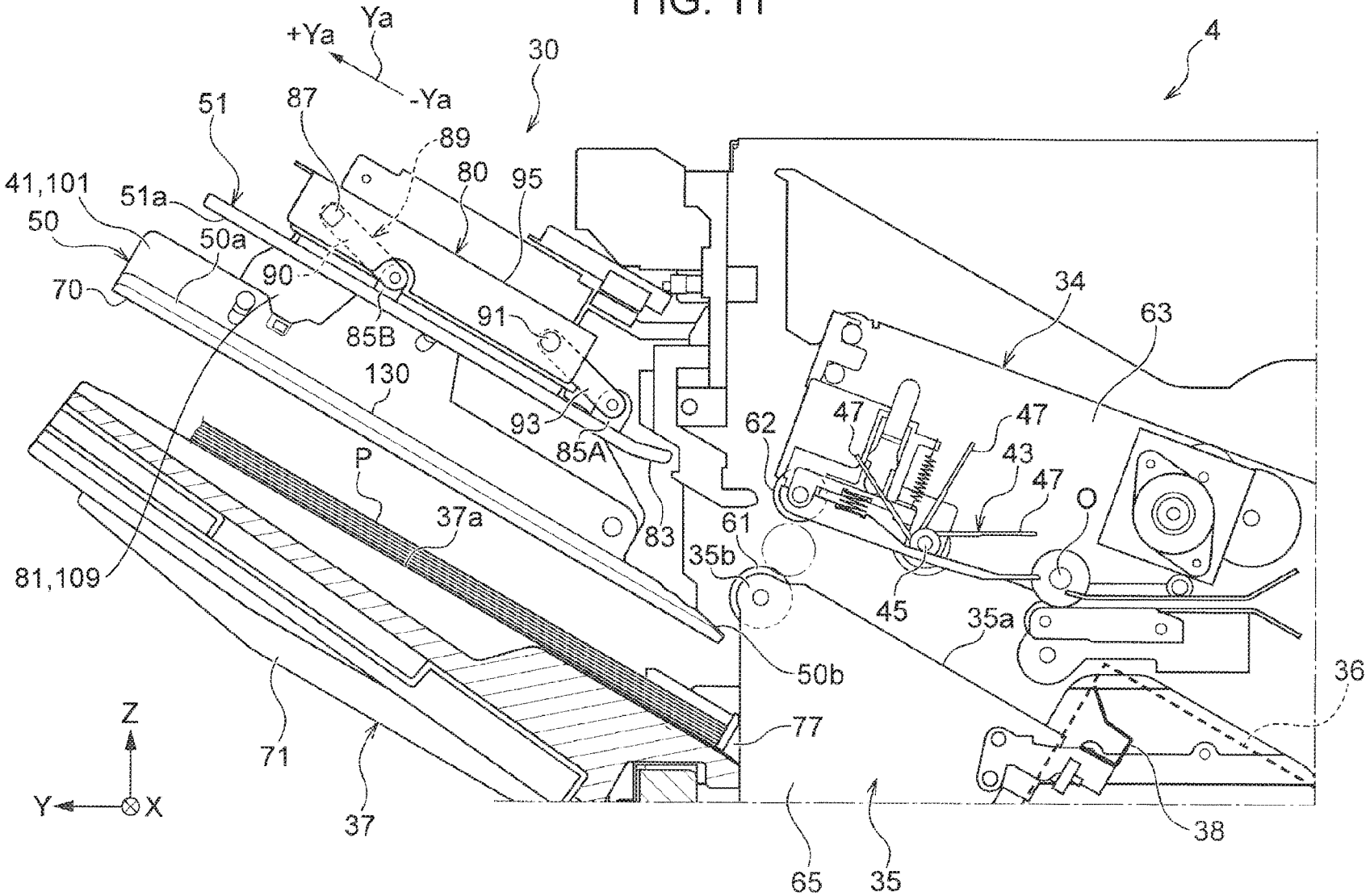
FIG. 11 is a side sectional view showing the processing device according to the present embodiment after stacking a medium.

Seventh Step (see FIGS. 10, 11, and 14)

The seventh step P7 is a stacking step in which the discharged bundle of media P is dropped from the medium supporting portion 50 and sequentially stacked on the stacking portion 37.

That is, the left and right medium supporting portions 50L and 50R are separated outward in the medium width direction X, and the bundle of medium P that has been supported is dropped downward to be supported on the stacking surface 37*a* of the stacking portion 37. At this time, the stacking height H of the bundle of dropping media P is lower than the first distance L1 which is the distance between the stacking surface 37*a* of the stacking portion 37 located at the uppermost position and the medium supporting portion 50. Therefore, the risk of the medium supporting portion 50 located above coming into contact with the medium P stacked on the stacking portion 37 is reduced.

When the medium P is stacked on the paper discharge tray 71 of the stacking portion 37, the sensor 79 detects it and the paper discharge tray 71 is lowered by a distance D corresponding to the height H of the media P in the stacking direction.

After that, the same operation is repeated to discharge and stack the subsequent bundle of media P, and the bundle of media P is sequentially stacked on the paper discharge tray 71.

Other Embodiments

The processing device 4, the control method of the processing device, and the recording system 1 according to the embodiment of the present disclosure are basically based on having the configuration as described above, but it is of course possible to change or omit the partial configuration of the above without departing from the scope of the present disclosure.

For example, the timing at which the pressing portion 51 performs the pressing may be performed each time the medium P is received one by one or may be performed at the timing when every several sheets are received. Alternatively, the processing may be performed at the timing when all the sheets of the medium P in a bundle are received.

Further, as the pressing mechanism 80 for driving the pressing portion 51, other mechanisms such as a cam mechanism and a rack and pinion mechanism other than the parallel link mechanism described in the above description of the embodiment may be used. Further, the moving direction of the pressing portion 51 is not limited to the one approaching the medium supporting portion 50 while swinging to the downstream +Ya in the paper discharge direction Ya described in the above description of the embodiment, and may be one that moves in the direction of the normal line in which the pressing portion 51 moves linearly and approaches toward the medium supporting portion 50.

Further, it is also possible to make the second position Q2 of the pressing portion 51 variable according to the thickness of the medium P or the stacking height H of the bundle of media P, or to provide the pressing portion 51 with an elastic action by interposing an elastic member or the like. In addition, a heater may be provided in the pressing portion 51 at a portion facing the curled portion of the medium P, and the heat of the heater may be used to reduce the curl of the medium P.

For example, at least a part of the pair of medium supporting portions 50 may have a structure that is inclined upward toward the downstream in the transport direction. The pair of medium supporting portions 50 may have a structure in which at least a part thereof is inclined downward toward the downstream in the transport direction.

Further, in order to further reduce the friction force between the lower surface of the medium P and the support surface 50*a*, a plurality of ribs extending in the width direction may be provided on the support surface 50*a* in the transport direction, or a plurality of convex portions may be randomly provided on the support surface 50*a*.

Further, the area of the inclined portion 130, the inclination start position and the inclination angle α, and the area for supporting the medium P in the lower support portion 70 of the medium supporting portion 50 are not limited to the case where they are always set to be constant. Specifically, a part or all of the area of the inclined portion 130, the inclination start position and the inclination angle α, and the area for supporting the medium P can be changed depending on the material, size, and thickness of the medium P, the amount of ink ejected onto the medium P, and the like.

Further, the shape of the inclined portion 130 is not limited to a linear shape and may be a curved shape or a bent shape that is bent a plurality of times. Further, the recording system 1 to which the processing device 4 including the paper discharge device 30 of the present embodiment is applied is not limited to the one to which the ink jet printer is applied as the printer portion 5, and may be the one to which the laser printer is applied, or may be the recording system 1 including the printer portion 5 alone without the scanner portion 6.

In the recording system 1, the intermediate device 3 may be omitted, the recording device 2 and the processing device 4 may be independent units in such a case, or the recording device 2 and the processing device 4 may be integrated. Further, the paper discharge device 30 may be mounted on the recording device 2.

What is claimed is:

1. A processing device comprising:

a medium supporting portion having a support surface for supporting at least a front end portion of a transported medium;

an aligning portion for aligning the medium supported by the medium supporting portion;

a stacking portion provided vertically below the medium supporting portion, having a stacking surface on which the medium dropped from the medium supporting portion is stacked, and configured to move up and down; and a pressing portion having a pressing surface facing the support surface, the pressing surface being configured to move between a first position and a second position closer to the support surface than the first position, wherein the pressing portion is disposed at the first position when the medium is transported to the medium supporting portion, and is disposed at the second position after the aligning portion aligns the medium on the medium supporting portion.

2. The processing device according to claim 1, wherein when a distance between the stacking surface in a state in which the stacking portion is located at an uppermost position and the medium supporting portion is a first distance and a distance between the pressing surface at the second position and the support surface is a second distance, the second distance is shorter than the first distance.

3. The processing device according to claim 2, wherein after the medium drops from the medium supporting portion, the stacking portion moves down a distance corresponding to a height of the dropped medium in a stacking direction.

4. The processing device according to claim 1, further comprising:

a medium mounting portion having a mounting surface configured to support a rear end portion of the transported medium, wherein the medium mounting portion is disposed such that a rear end of the support surface in the transport direction is lower than a front end of the mounting surface in the transport direction, and when a distance between the pressing surface at the second position and the support surface is a second distance, a distance between the rear end of the support surface in a transport direction and the front end of the mounting surface in the transport direction is longer than the second distance.

5. The processing device according to claim 4, further comprising:

a processing portion for processing the medium mounted on the medium mounting portion.

6. The processing device according to claim 1, wherein the medium supporting portion is provided as a pair so as to face each other in a width direction intersecting a transport direction in which the medium is transported, has a support surface that supports the medium, and supports an outer side of a center of the transported medium in the width direction, and the pair of medium supporting portions has an inclined portion that is inclined downward toward a center in the width direction on at least a portion of the support surface.

7. A control method of a processing device including a medium supporting portion having a support surface for supporting at least a front end portion of a transported medium, an aligning portion for aligning the medium supported by the medium supporting portion, a stacking portion provided vertically below the medium supporting portion, having a stacking surface on which the medium dropped from the medium supporting portion is stacked, and configured to move up and down, and a pressing portion having a pressing surface facing the support surface, the pressing surface being configured to move between a first position and a second position closer to the support surface than the first position, the method comprising:

disposing the pressing portion at the first position;

transporting the medium to the medium supporting portion after the pressing portion is disposed at the first position;

aligning the medium supported by the medium supporting portion with the aligning portion; and disposing the pressing portion at the second position after aligning the medium with the aligning portion.

8. The control method of the processing device according to claim 7, wherein when a distance between the stacking surface in a state in which the stacking portion is located at an uppermost position and the medium supporting portion is a first distance, the pressing portion is disposed at the second position in which a distance between the pressing surface and the support surface is a second distance shorter than the first distance after aligning the medium with the aligning portion.

9. The control method of the processing device according to claim 8, wherein after the medium drops from the medium supporting portion, the stacking portion moves down a distance corresponding to a height of the dropped medium in a stacking direction.

10. A recording system comprising:

a recording device including a recording portion for performing recording on a medium and a discharging portion for discharging the medium from the recording portion; and a processing device including a medium introducing portion for introducing the medium discharged from the discharging portion, a medium supporting portion having a support surface for supporting at least a front end portion of the medium introduced and transported from the medium introducing portion, an aligning portion for aligning the medium supported by the medium supporting portion, a stacking portion provided vertically below the medium supporting portion, having a stacking surface on which the medium dropped from the medium supporting portion is stacked, and configured to move up and down, and a pressing portion having a pressing surface facing the support surface, the pressing surface being configured to move between a first position and a second position closer to the support surface than the first position, wherein the pressing portion is disposed at the first position when the medium is transported to the medium supporting portion, and is disposed at the second position after the aligning portion aligns the medium on the medium supporting portion.

* * * * *